US005792599A

United States Patent [19]

Taguchi

[11] Patent Number: 5,792,599

[45] Date of Patent: Aug. 11, 1998

[54] COLOR PHOTOGRAHIC MATERIAL

[75] Inventor: Toshiki Taguchi, Kanagawa, Japan

[73] Assignee: Fuji Photo Film Co., Ltd., Kanagawa, Japan

[21] Appl. No.: 710,720

[22] Filed: Sep. 20, 1996

[30] Foreign Application Priority Data

Sep. 22, 1995 [JP] Japan ..... 7-244699

[51] Int. Cl.[6] ..... G03C 1/46

[52] U.S. Cl. ..... 430/505; 430/448; 430/486; 430/506; 430/478; 430/464; 430/543; 430/502; 430/503

[58] Field of Search ..... 430/505, 448, 430/486, 566, 478, 464, 543, 502, 503

[56] References Cited

U.S. PATENT DOCUMENTS 4,021,240 5/1977 Cerquone et al. ..... 96/29
4,346,154 8/1982 McLean et al. ..... 430/448
4,447,522 5/1984 Hirano et al. ..... 430/448
5,302,498 4/1994 Southby et al. ..... 430/448

FOREIGN PATENT DOCUMENTS 60-128438 7/1985 Japan .

*Primary Examiner*—Geraldine Letscher
*Attorney, Agent, or Firm*—Sughrue, Mion, Zinn, Macpeak & Seas, PLLC

[57] ABSTRACT

Provided is a color photographic material excellent in discrimination and color reproducibility, which has a support and at least a light-sensitive silver halide, a binder, a coupler and a coupling developing agent provided thereon, and at least three light-sensitive emulsion layers having spectral sensitivities in different wavelength regions, respectively, in which at least two different coupling development agents are contained in different light-sensitive emulsion layers.

10 Claims, No Drawings

COLOR PHOTOGRAHIC MATERIAL

FIELD OF THE INVENTION

The present invention relates to a color photographic material, and particularly to a heat developable color photographic material.

BACKGROUND OF THE INVENTION

Photographic methods using silver halides are excellent in photographic characteristics such as sensitivity and gradation control, as compared with other photographic methods such as electrophotographic methods and diazo photographic methods, and therefore have previously been most widely used. In particular, the photographic methods using silver halides provide highest image quality as color hard copies, so that intensive investigation has recently been conducted on them.

In recent years, systems which can obtain images easily and rapidly have been developed by shifting image formation processing of photographic materials using silver halides from conventional wet processing to instant photographic systems containing a developing solution and further to dry heat development processing by heating. Heat developable photographic materials are described in *Shashin Kohqaku no Kiso* (*Higinen Shashin*) (*The Fundamentals of Photographic Engineering* (*Nonsilver Photograph*)), infra page 242, Corona Publishing Co. Ltd. However, black-and-white image forming methods represented by dry silver are merely described therein. Recently, commercial products such as Pictorography and Pictorostat supplied from Fuji Photo Film Co., Ltd. have been put on the market. The above-mentioned easy rapid processing methods use a redox color material to which a preformed dye is attached to form color images. Methods utilizing coupling reaction of a coupler and an oxidized product of a developing agent are most general as the color image forming methods of photographic materials. As to heat developable color photographic materials employing these methods, many ideas are also applied for patents, for example, U.S. Pat. Nos. 3,761,270 and 4,021,240, and JP-A-59-231539 (the term "JP-A" as used herein means an "unexamined published Japanese patent application").

In the case where a photographic material is developed with an ordinary developing solution, development is conducted by a single developing agent contained in the developing solution. In this case, the difference in coupler activity between couplers contained in respective light-sensitive emulsion layers produces the difference in color forming rate between respective colors. The coupler activity is required to be controlled to improve this.

In the developing agent and coupler-containing heat developable color photographic materials described above which have been studied by the present inventors, the developing agents can be contained, resulting in the possibility of containing coupling developing agents suitable for respective emulsion layers. However, when color photographic materials of the multilayer constitution containing coupling developing agents (hereinafter briefly referred to as "developing agents") are formed, the problem is encountered that oxidants of the developing agents transfer to other light-sensitive layers. When the oxidants of the developing agents transfer to the other layers and the coupling reaction is conducted therein, dye images of layers in which the color should ordinarily not be developed are produced, which causes deterioration of color reproducibility of images.

We call this phenomenon "crosstalk". As prior art, there is a well-known method in which a light-insensitive intermediate layer is provided between light-sensitive layers adjacent to each other, and in which a compound capable of rapidly reducing the oxidant of the developing agent is introduced into the intermediate layer. The present inventors have also studied this method. However, if the amount of the reducing agent contained in the intermediate layer is increased, the silver development reaction independent of dye formation takes place together, which raises the problem that the maximum density (Dmax) of an image is decreased.

The present inventors have studied various ideas in order to solve this problem. As a result, the present inventors have considered that it will be effective Lo optimize developing agents for respective emulsion layers, and to construct such a reaction system that even if an oxidant of the developing agent is diffused into the adjacent light-sensitive layer, it does not react with a coupler contained in that layer.

SUMMARY OF THE INVENTION

It is therefore an object of the present invention to provide a heat developable color photographic material excellent in discrimination and color reproducibility.

The object of the present invention has been accomplished by the following embodiments.

(i) A color photographic material comprising a support having provided thereon at least a light-sensitive silver halide, a binder, a coupler and a coupling developing agent, and at least three light-sensitive emulsion layers having spectral sensitivities in different wavelength regions, respectively, in which at least two different coupling development agents are contained in different light-sensitive emulsion layers, respectively.

(ii) The color photographic material of item (i), in which the different developing agents contained in the light-sensitive emulsion layers adjacent to each other are agents one of which is coupled with a coupler of the light-sensitive emulsion layer containing the developing agent itself to form a dye, but does not form a dye with a coupler contained in the adjacent light-sensitive emulsion layer.

(iii) The color photographic material of item (ii), in which one light-sensitive emulsion layer contains a 4-equivalent coupler and at least one developing agent selected from the group consisting of compounds represented by formulas (1) to (3) and a light-sensitive emulsion layer adjacent to the light-sensitive emulsion layer contains a 2-equivalent coupler and at least one developing agent selected from the group consisting of compounds represented by formulas (4) and (5):

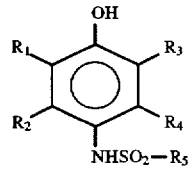

(1)

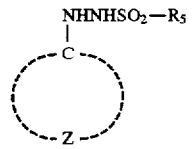

(2)

-continued (3)

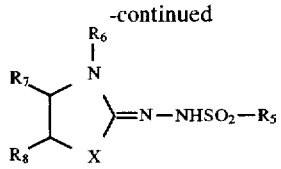

(4)

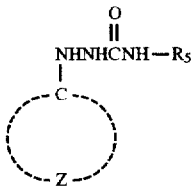

(5)

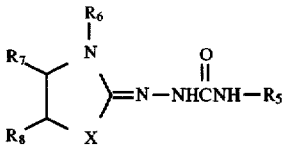

wherein $R_1$ to $R_4$ each represents a hydrogen atom, a halogen atom, an alkyl group, an aryl group, an alkylcarbonamido group, an arylcarbonamido group, an alkylsulfonamido group, an arylsulfonamido group, an alkoxyl group, an aryloxy group, an alkylthio group, an arylthio group, an alkylcarbamoyl group, an arylcarbamoyl group, a carbamoyl group, an acylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl, aryl or heterocyclic group; Z represents an atomic group for forming an aromatic ring (containing a heterocyclic aromatic ring), wherein when Z is a benzene ring, the sum of the Hammett constants ($\sigma_p$) of substituents for the benzene ring is 1 or more; $R_6$ represents a substituted or unsubstituted alkyl group; X represents an oxygen atom, a sulfur atom, a selenium atom or an alkyl-substituted or aryl-substituted tertiary nitrogen atom; and $R_7$ and $R_8$, which may be combined with each other to form a double bond or a ring, each represents a hydrogen atom or a substituent.

DETAILED DESCRIPTION OF THE INVENTION

The present invention will be described in detail below.

Although the object of the present invention is to obtain the color photographic materials excellent in discrimination of color images, using the different developing agents for the respective light-sensitive emulsion layers, the final object aimed by the technique of the present invention is to prevent the color mixture reaction even when the developing agents or the couplers are diffused or transfer to the adjacent light-sensitive emulsion layers. The "adjacent light-sensitive layers" used herein mean two layers α and β different from each other in spectral sensitivity in which the layer α is disposed next to the layer β from a support, or in which they are disposed in the reverse order. In this case, even when a light-insensitive intermediate layer intervenes between the layers α and β, they are also called "adjacent light-sensitive layers". When layers having the same spectral sensitivity and containing silver halide grains different in grain size are formed in the layer form by coating one over the other in several divided layers for the purposes of softening the gradation of images and improving the graininess, though this technique is frequently used in photographic materials, the group of light-sensitive emulsion layers are understood to be considered as one light-sensitive emulsion layer in this invention.

In order to design a photographic material achieving the object of the present invention, it is necessary to consider a process containing two sets of dye formation coupling reaction systems as reaction systems. When couplers contained in the two reaction systems are taken as $C_1$ and $C_2$, respectively, and developing agents are taken as $D_1$ and $D_2$, respectively, $C_1$ and $D_1$, and $C_2$ and $D_2$ are required to be combinations which undergo the coupling reaction, and $C_2$ and $D_1$, and $C_1$ and $D_2$ are required to be combinations which do not substantially undergo the coupling reaction. Such systems can be formed by selecting a 4-equivalent coupler as $C_1$, a 2-equivalent coupler as $C_2$, a developing agent represented by the above-mentioned general formula (1), (2) or (3) as $D_1$, and a developing agent represented by the above-mentioned general formula (4) or (5) as $D_2$.

The compounds represented by general formula (1) are compounds generically named sulfonamidophenols and known in the art.

In general formula (1), $R_1$ to $R_4$ each represents a hydrogen atom, a halogen atom (for example, chlorine or bromine), an alkyl group (preferably having 1 to 80 carbon atoms, for example, methyl, ethyl, isopropyl, n-butyl or t-butyl), an aryl group (preferably having 6 to 80 carbon atoms, for example, phenyl, tolyl or xylyl), an alkylcarbonamido group (preferably having 2 to 80 carbon atoms, for example, acetylamino, propionylamino or butyroylamino), an arylcarbonamido group (preferably having 7 to 80 carbon atoms, for example, benzoylamino), an alkylsulfonamido group (preferably having 1 to 80 carbon atoms, for example, methanesulfonylamino or ethanesulfonyl-amino), an arylsulfonamido group (preferably having 6 to 80 carbon atoms, for example, benzenesulfonylamino or toluenesulfonylamino), an alkoxyl group (preferably having 1 to 80 carbon atoms, for example, methoxy, ethoxy or butoxy), an aryloxy group (preferably having 6 to 80 carbon atoms, for example, phenoxy), an alkylthio group (preferably having 1 to 80 carbon atoms, for example, methylthio, ethylthio or butylthio), an arylthio group (preferably having 6 to 80 carbon atoms, for example, phenylthio or tolylthio), an alkylcarbamoyl group (preferably having 2 to 80 carbon atoms, for example, methylcarbamoyl, dimethylcarbamoyl, ethylcarbamoyl, diethylcarbamoyl, dibutylcarbamoyl, piperidylcarbamoyl or morpholylcarbamoyl), an arylcarbamoyl group (preferably having 7 to 80 carbon atoms, for example, phenylcarbamoyl, methylphenyl carbamoyl, ethylphenyl-carbamoyl or benzylphenylcarbamoyl), a carbamoyl group, an alkylsulfamoyl group (preferably having 1 to 80 carbon atoms, for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (preferably having 6 to 80 carbon atoms, for example, phenylsulfamoyl, methylphenylsulfamoyl, ethylphenylsulfamoyl or benzylphenylsulfamoyl), a sulfamoyl group, a cyano group, an alkylsulfonyl group (preferably having 1 to 80 carbon atoms, for example, methanesulfonyl or ethanesulfonyl), an arylsulfonyl group (preferably having 6 to 80 carbon atoms, for example, phenylsulfonyl, 4-chlorophenylsulfonyl or p-toluenesulfonyl), an alkoxycarbonyl group (preferably having 2 to 80 carbon atoms, for example, methoxycarbonyl, ethoxy-carbonyl or butoxycarbonyl), an aryloxycarbonyl group (preferably having 7 to 80 carbon atoms, for example, phenoxycarbonyl), an alkylcarbonyl group (preferably having 2 to 80 carbon atoms, for example, acetyl, propionyl or butyroyl), an arylcarbonyl group (preferably having 7 to 80 carbon atoms, for example, benzoyl or alkylbenzoyl) or an acyloxy group (preferably having 2 to 80 carbon atoms, for example, acetyloxy, propionyloxy or butyroyloxy). Of $R_1$ to $R_4$, $R_2$ and $R_4$ each is preferably a hydrogen atom. It is preferred that the sum of the Hammett constants ($\sigma_p$) of $R_1$ to $R_4$ amounts to 0 or more.

$R_5$ represents an alkyl group (preferably having 1 to 80 carbon atoms, for example, methyl, ethyl, butyl, octyl, lauryl, cetyl or stearyl), an aryl group (preferably having 6 to 80 carbon atoms, for example, phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di(methoxycarbonyl)phenyl) or a heterocyclic group (preferably having 1 to 80 carbon atoms, for example, pyridyl).

The compounds represented by general formula (2) are compounds generically named sulfonylhydrazines. Further, the compounds represented by general formula (4) are compounds generically named carbamoylhydrazines. Both are compounds known in the art.

In general formulas (2) and (4), Z represents an atomic group for forming an aromatic ring. The aromatic ring formed by Z is required to be sufficiently electron-attractive to impart the silver development activity to this compound. Accordingly, a nitrogen-containing aromatic ring or an aromatic ring into which an electron-attractive group is introduced is preferably used. Preferred examples of such aromatic rings include pyridine, pyrazine, pyrimidine, quinoline and quinoxaline rings.

For the benzene ring, a substituent thereof is an alkylsulfonyl group (preferably having 1 to 80 carbon atoms, for example, methanesulfonyl or ethane-sulfonyl), a halogen atom (for example, chlorine or bromine), an alkylcarbamoyl group (preferably having 2 to 80 carbon atoms, for example, methylcarbamoyl, dimethylcarbamoyl, ethylcarbamoyl, diethylcarbamoyl, dibutyl-carbamoyl, piperidylcarbamoyl or morpholylcarbamoyl), an arylcarbamoyl group (preferably having 7 to 80 carbon atoms, for example, phenylcarbamoyl, methyl-phenylcarbamoyl, ethylphenylcarbamoyl or benzylphenyl-carbamoyl), a carbamoyl group, an alkylsulfamoyl group (preferably having 1 to 80 carbon atoms, for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (preferably having 6 to 80 carbon atoms, for example, phenylsulfamoyl, methylphenylsulfamoyl, ethylphenylsulfamoyl or benzylphenylsulfamoyl), a sulfamoyl group, a cyano group, an alkylsulfonyl group (preferably having 1 to 80 carbon atoms, for example, methanesulfonyl or ethanesulfonyl), an arylsulfonyl group (preferably having 6 to 80 carbon atoms, for example, phenylsulfonyl, 4-chlorophenylsulfonyl or p-toluenesulfonyl), an alkoxycarbonyl group (preferably having 2 to 80 carbon atoms, for example, methoxycarbonyl, ethoxy-carbonyl or butoxycarbonyl), an aryloxycarbonyl group (preferably having 7 to 80 carbon atoms, for example, phenoxycarbonyl), an alkylcarbonyl group (preferably having 2 to 80 carbon atoms, for example, acetyl, propionyl or butyroyl) or an arylcarbonyl group (preferably having 7 to 80 carbon atoms, for example, benzoyl or alkylbenzoyl). The sum of the Hammett constants $\sigma_p$ values of the substituent(s) for the benzene ring is 1 or more.

The compounds represented by general formula (3) are compounds generically named sulfonylhydrazones. Further, the compounds represented by general formula (5) are compounds generically named carbamoylhydrazones. Both are compounds known in the art.

In general formulas (3) and (5), $R_6$ represents a substituted or unsubstituted alkyl group (preferably having 1 to 80 carbon atoms, for example, methyl or ethyl), and X represents an oxygen atom, a sulfur atom, a selenium atom or an alkyl-substituted or aryl-substituted tertiary nitrogen atom. An alkyl-substituted tertiary nitrogen atom is preferred. $R_7$ and $R_8$, which may be combined with each other to form a double bond or a ring, each represents a hydrogen atom or a substituent such as a halogen atom (e.g., chlorine and bromine), a substituted or unsubstituted alkyl group, a substituted or unsubstituted aryl group, or a substituted or unsubstituted heterocyclic ring.

Examples of the compounds represented by general formulas (1) to (5) are shown below, but the compounds used in the present invention are not, of course, limited thereto.

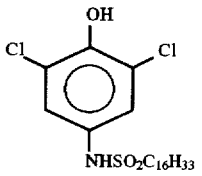

D-1

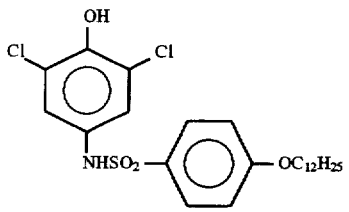

D-2

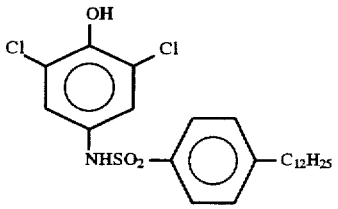

D-3

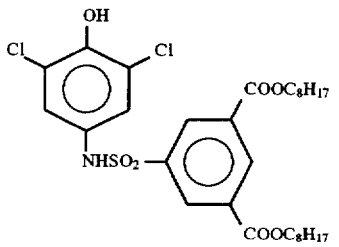

D-4

-continued
D-5
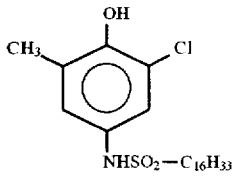
D-6
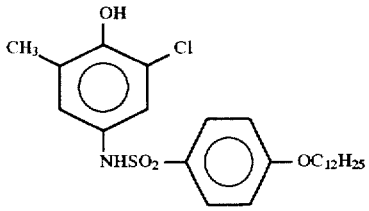
D-7
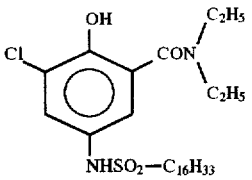
D-8
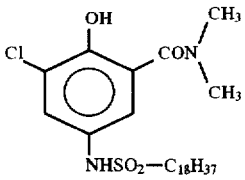
D-9
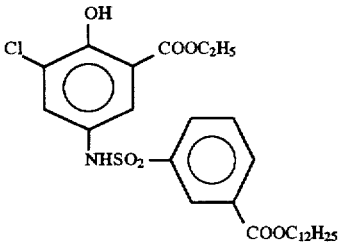
D-10
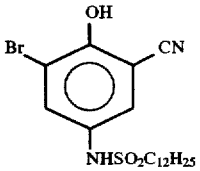
D-11
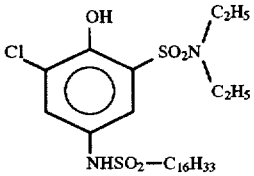
D-12
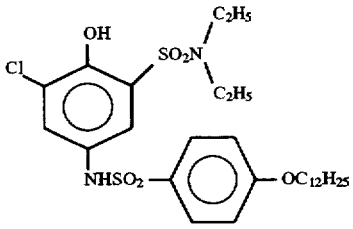
D-13
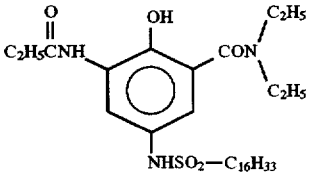
D-14
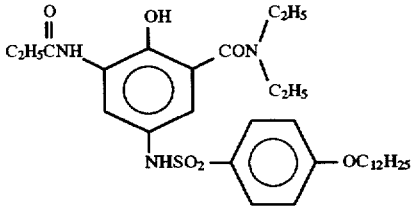
D-15
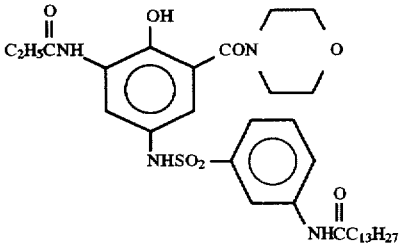
D-16
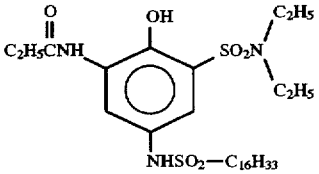
D-17
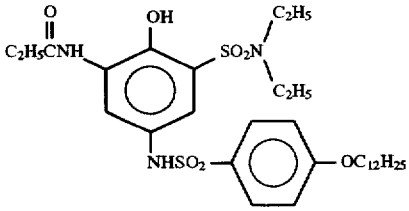
D-18
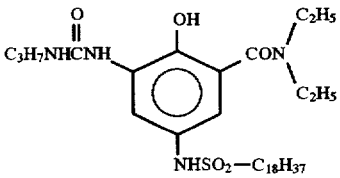

-continued
D-19
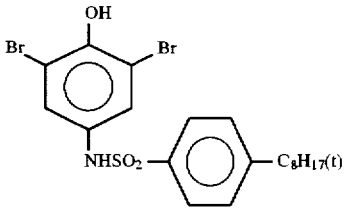
D-20
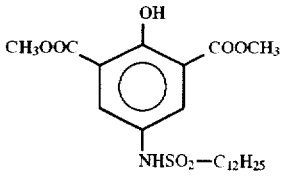
D-21
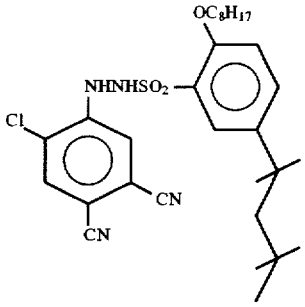
D-22
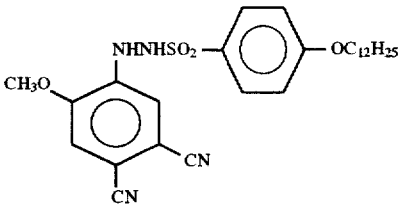
D-23
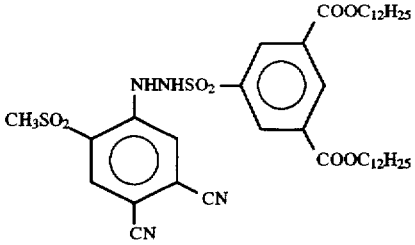
D-24
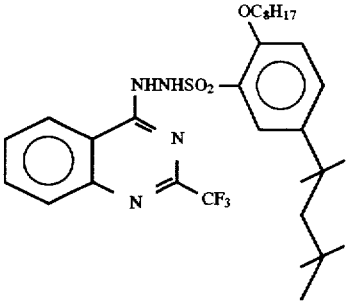
D-25
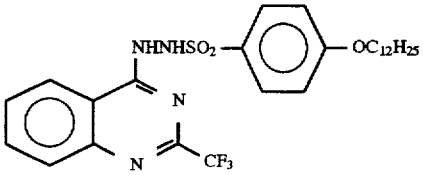
D-26
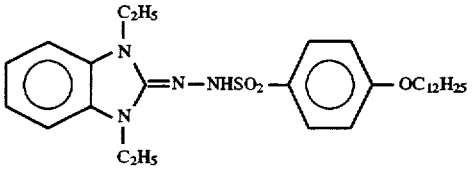
D-27
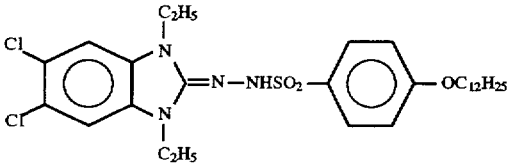
D-28
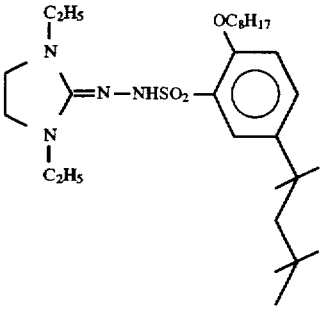
D-29
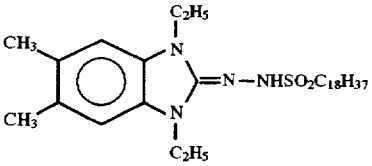
D-30
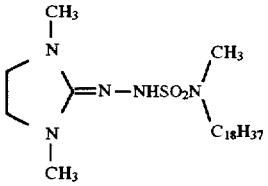

-continued
D-31
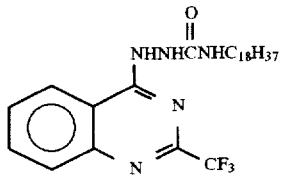
D-32
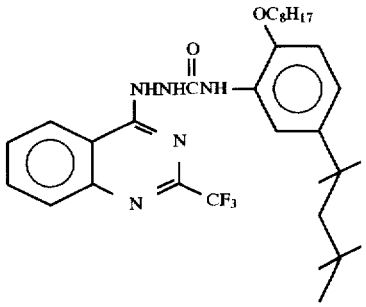
D-33
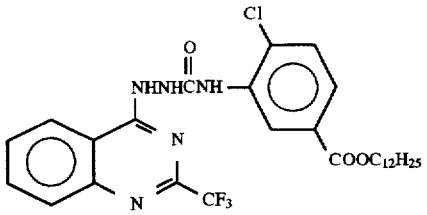
D-34
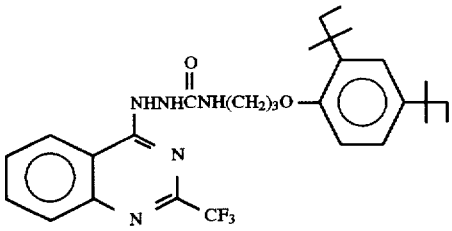
D-35
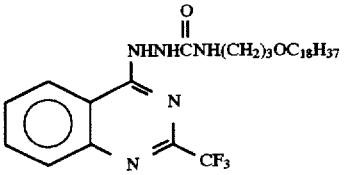
D-36
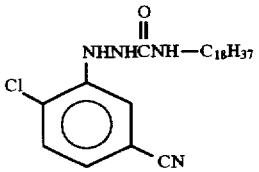
D-37
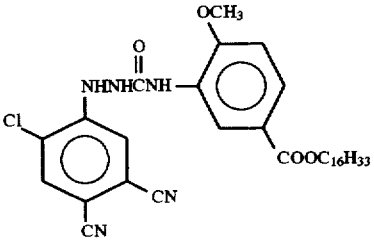
D-38
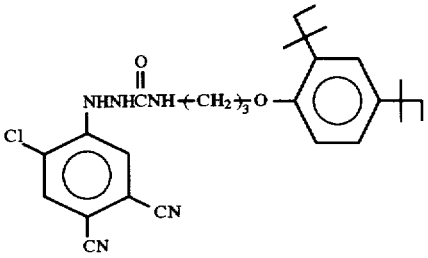
D-39
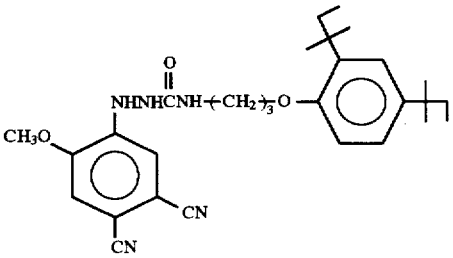
D-40
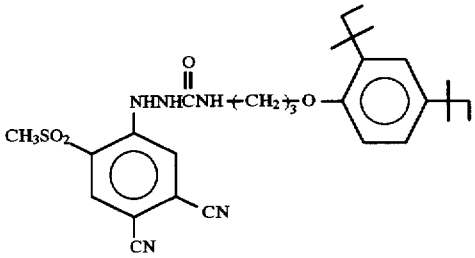
D-41
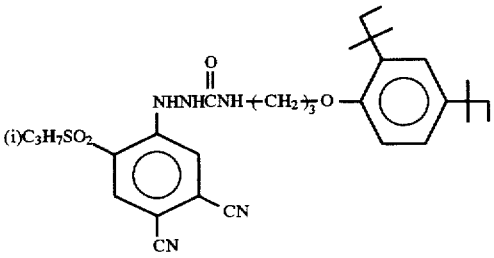
D-42
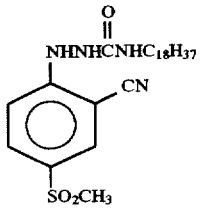

-continued
D-43
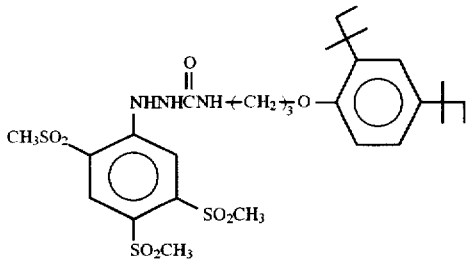
D-44
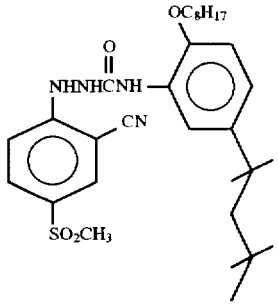
D-45
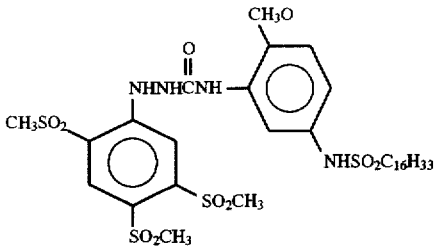
D-46
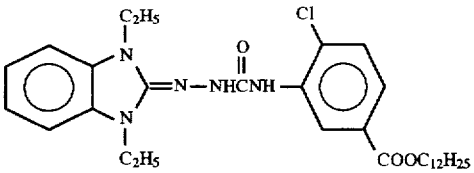
D-47
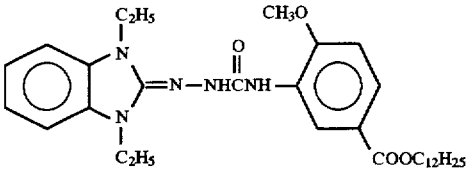
D-48
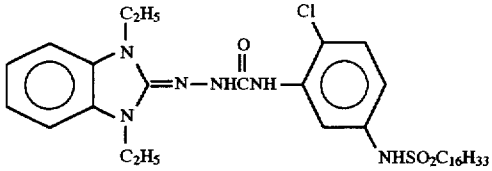
D-49
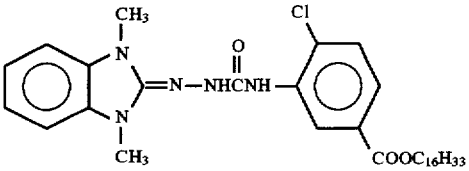
D-50
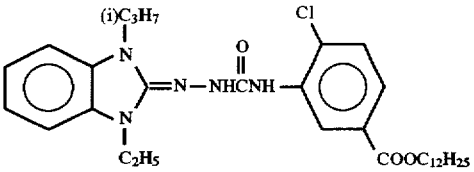
D-51
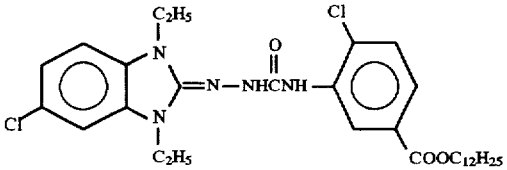
D-52
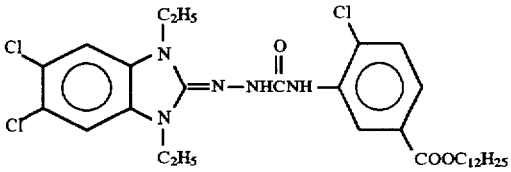
D-53
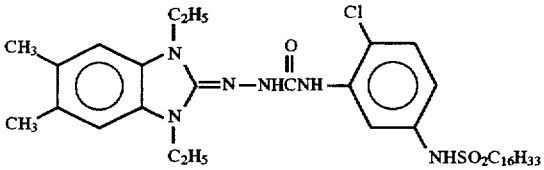
D-54
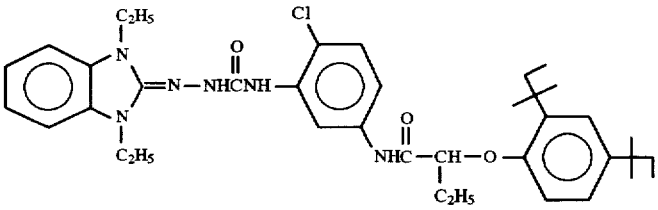

-continued
D-55
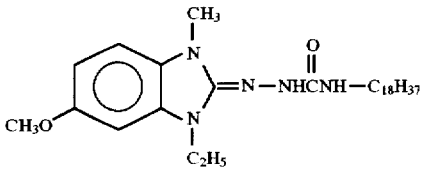
D-56
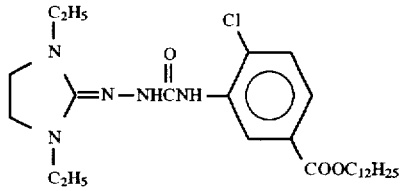
D-57
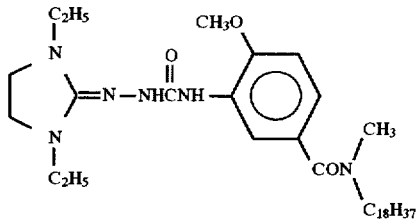
D-58
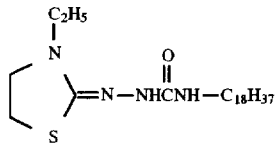
D-59
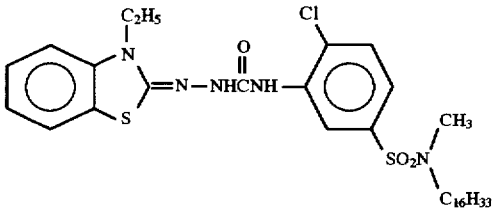
D-60
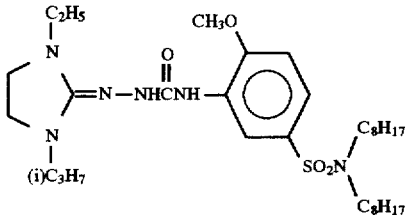
The above-mentioned compounds can be synthesized by known methods. Synthesis routes are briefly enumerated below:
Synthesis of Developing Agent D-2
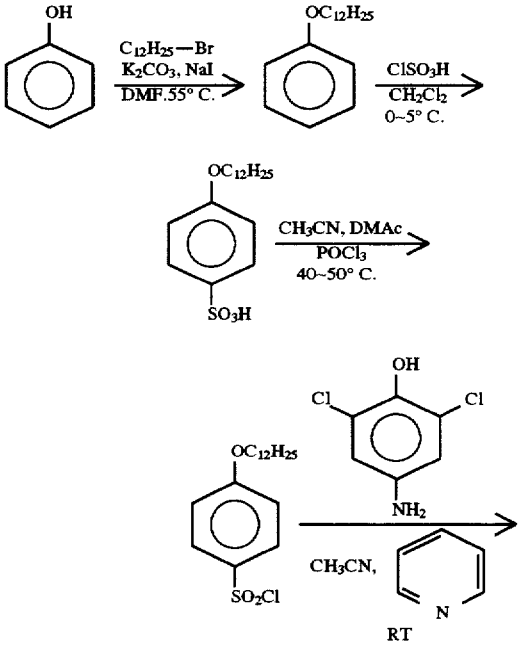
Synthesis of Developing Agent D-31
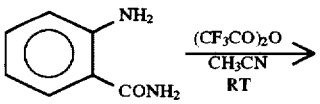
-continued
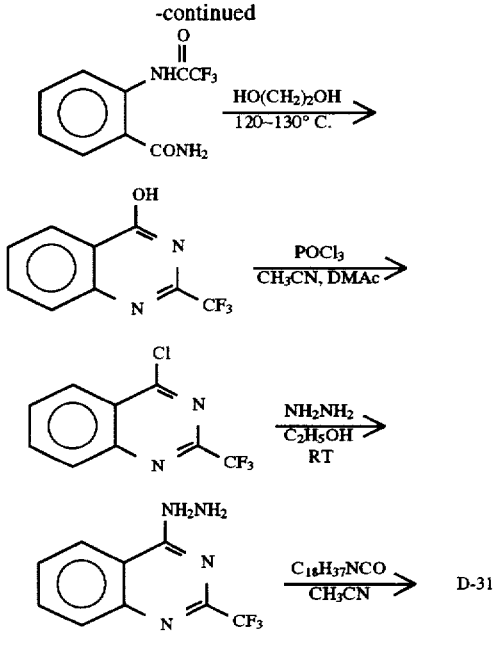
Syntheis of Developing Agent D-46
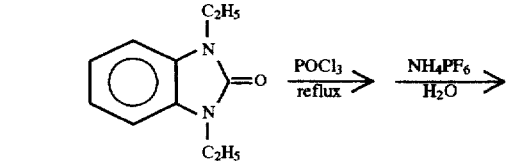

-continued

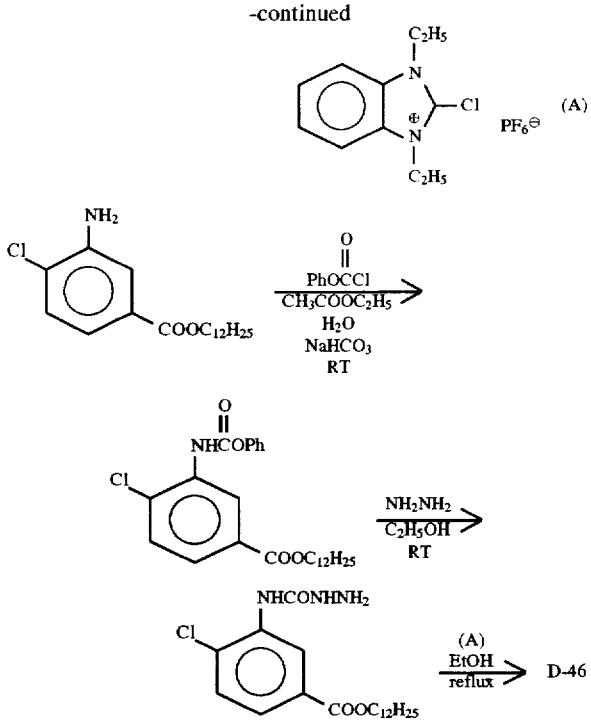

In the present invention, compounds (couplers) which form dyes by the oxidation coupling reaction are used as dye donating compounds. It is preferred in the present invention that a 4-equivalent coupler or a 2-equivalent coupler is appropriately used as the coupler depending on the kind of developing agent.

First, the 4-equivalent couplers are used for the developing agents represented by general formulas (1) to (3). In the developing agent represented by general formulas (1) to (3), the coupling site is substituted by a sulfonyl group, and the sulfonyl group is removed as sulfinic acid on coupling. Accordingly, the removable group from the coupler side must be removed as a cation. Therefore, the developing agent is reacted with the 4-equivalent coupler which can release a proton as the removable group on coupling, but is not reacted with the 2-equivalent coupler in which the removable group is an anion.

Conversely, the 2-equivalent coupler is used for the developing agent represented by general formulas (4) to (5). In the developing agent represented by general formulas (4) to (5), the coupling site is substituted by a carbamoyl group, and a hydrogen atom on the nitrogen atom is removed as a proton on coupling. Accordingly, the removable group from the coupler side must be removed as an anion. Therefore, the developing agent is reacted with the 2-equivalent coupler which can release an anion as the removable group on coupling, but is not reacted with the 4-equivalent coupler in which the removable group is a proton.

Examples of both the 4-equivalent and 2-equivalent couplers are described in detail in *Theory of the Photographic Process*, 4th ed., edited by T. H. James, pages 291 to 334 and 354 to 361, Macmillan, 1977, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Preferred examples of the couplers used in the present invention are enumerated below.

Compounds having structures represented by the following general formulas (6) to (17) are preferably used as the couplers in the present invention. These are compounds which are generically named active methylene, pyrazolone, pyrazoloazole, phenol, and naphthol, respectively, and are well known in the art.

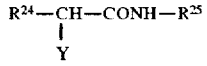

(6)

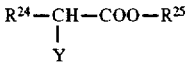

(7)

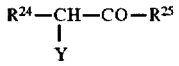

(8)

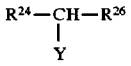

(9)

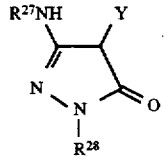

(10)

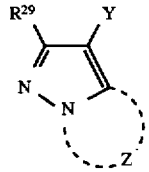

(11)

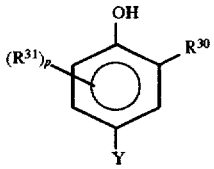

(12)

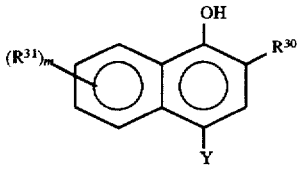

(13)

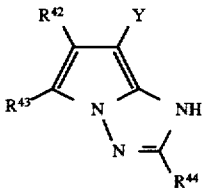

(14)

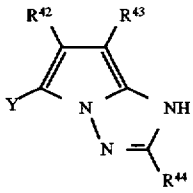

(15)

-continued (16)

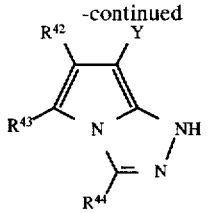

(17)

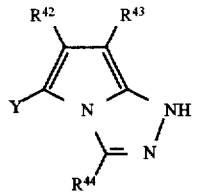

General formulas (6) to (9) indicate couplers referred to as active methylene couplers, wherein $R^{24}$ is an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, which may have a substituent. It is preferred that $R^{24}$ has 1 to 40 carbon atoms, more preferably from 1 to 20 carbon atoms, most preferably from 1 to 8 carbon atoms.

In general formulas (6) to (9), $R^{25}$ is an alkyl group, an aryl group or a heterocyclic group, which may have a substituent. In general formula (9), $R^{26}$ is an aryl group or a heterocyclic group, which may have a substituent. It is preferred that $R^{25}$ and $R^{26}$ each independently has 1 to 40 carbon atoms, more preferably from 6 to 40 carbon atoms, most preferably from 6 to 30 carbon atoms.

The substituents which $R^{24}$, $R^{25}$ and $R^{26}$ may have include various substituents (e.g., alkyl, cycloalkyl, alkenyl, alkynyl, aryl, heterocyclic, alkoxyl, aryloxy, cyano, acylamino, sulfonamido, carbamoyl, sulfamoyl, alkoxycarbonyl, aryloxycarbonyl, alkylamino, arylamino, hydroxyl and sulfo) and a halogen atom. Preferred examples of $R^{24}$ include acyl, cyano, carbamoyl and alkoxycarbonyl groups.

In general formulas (6) to (9), Y is a hydrogen atom or a group which is removable by the coupling reaction with an oxidized product of a developing agent. Examples of the group represented by Y functioning as an anionic removable group of the 2-equivalent coupler include a halogen atom (for example, chlorine and bromine), an alkoxyl group (for example, methoxy or ethoxy), an aryloxy group (for example, phenoxy, 4-cyanophenoxy or 4-alkoxycarbonylphenyl), an alkylthio group (for example, methylthio, ethylthio or butylthio), an arylthio group (for example, phenylthio or tolylthio), an alkylcarbamoyl group (for example, methylcarbamoyl, dimethylcarbamoyl, ethylcarbamoyl, diethylcarbamoyl, dibutylcarbamoyl, piperidylcarbamoyl or morpholylcarbamoyl), an arylcarbamoyl group (for example, phenyl-carbamoyl, methylphenylcarbamoyl, ethylphenylcarbamoyl or benzylphenylcarbamoyl), a carbamoyl group, an alkylsulfamoyl group (for example, methylsulfamoyl, dimethylsulfamoyl, ethylsulfamoyl, diethylsulfamoyl, dibutylsulfamoyl, piperidylsulfamoyl ormorpholylsulfamoyl), an arylsulfamoyl group (for example, phenylsulfamoyl, methylphenylsulfamoyl, ethylphenylsulfamoyl or benzylphenylsulfamoyl), a sulfamoyl group, a cyano group, an alkylsulfonyl group (for example, methanesulfonyl or ethanesulfonyl), an arylsulfonyl group (for example, phenylsulfonyl, 4-chlorophenylsulfonyl or p-toluenesulfonyl), an alkylcarbonyloxy group (for example, acetyloxy, propionyloxy or butyroyloxy), an arylcarbonyloxy group (for example, benzoyloxy, tolyloxy or anisyloxy) and a nitrogen-containing heterocyclic group (for example, imidazolyl or benzotriazolyl).

Further, examples of the group functioning as the cationic removable group of the 4-equivalent coupler include a hydrogen atom, a formyl group, a carbamoyl group, a methylene group having a substituent (examples of the substituent include an aryl group, a sulfamoyl group, a carbamoyl group, an alkoxyl group, an amino group, and a hydroxyl group), an acyl group and a sulfonyl group.

In general formulas (6) to (9), $R^{24}$ and $R^{25}$, or $R^{24}$ and $R^{26}$ may be combined with each other to form a ring.

General formula (10) represents couplers called 5-pyrazolone magenta couplers. In general formula (10), $R^{27}$ represents an alkyl group, an aryl group, an acyl group or a carbamoyl group. $R^{28}$ represents a phenyl group or a phenyl group having at least one of a halogen atom, an alkyl group, a cyano group, an alkoxyl group, an alkoxycarbonyl group, and an acylamino group as substituent(s). Y has the same meaning as in general formulas (6) to (9).

Of the 5-pyrazolone magenta couplers represented by general formula (10), couplers are preferred in which $R^{27}$ is an aryl group or an acyl group and $R^{28}$ is a phenyl group having at least one halogen atom as a substituent.

These preferred groups are described in detail. $R^{27}$ is an aryl group such as phenyl, 2-chlorophenyl, 2-methoxyphenyl, 2-chloro-5-tetradecaneamidophenyl, 2-chloro-5-(3-octadecenyl-1-succinimido)phenyl, 2-chloro-5-octadecylsulfon-amidophenyl or 2-chloro-5-[2-(4-hydroxy-3-t-butylphenoxy)-tetradecaneamido]phenyl, or an acyl group such as acetyl, pivaloyl, tetradecanoyl, 2-(2,4-di-t-pentylphenoxy)acetyl, 2-(2,4-di-t-pentylphenoxy)butanoyl, benzoyl or 3-(2,4-di-t-amylphenoxyacetazido)benzoyl. These groups may further have substituent(s) which is an organic substituent linked through a carbon atom, a oxygen atom, a nitrogen atom or a sulfur atom, or a halogen atom.

$R^{28}$ is preferably a substituted phenyl group such as 2,4,6-trichlorophenyl, 2,5-dichlorophenyl or 2-chlorophenyl.

General formula (11) represents couplers called pyrazoloazole couplers. In general formula (11), $R^{29}$ represents a hydrogen atom or a substituent. Z represents a group of nonmetal atoms necessary for forming a 5-membered azole ring containing 2 to 4 nitrogen atoms, and the azole ring may have a substituent (including a condensed ring). Y has the same meaning as in general formulas (6) to (9).

Of the pyrazoloazole couplers represented by general formula (11), imidazo[1,2-b]pyrazoles described in U.S. Pat. No. 4,500,630, pyrazolo[1,5-b][1,2,4]triazoles described in U.S. Pat. No. 4,540,654 and pyrazolo[5,1-c][1,2,4]triazoles described in U.S. Pat. No. 3,725,067 are preferred in respect to absorption characteristics of color developing dyes. Of these, pyrazolo[1,5-b][1,2,4]triazoles are preferred in respect to light fastness.

Details of the substituents for the azole ring represented by $R^{29}$, Y and Z are described, for example, in U.S. Pat. No. 4,540,654, the second column, line 41 to the eighth column, line 27. Preferred examples thereof include pyrazoloazole couplers in each of which a branched alkyl group is directly connected to the 2-, 3- or 6-position of a pyrazolotriazole ring as described in JP-A-61-65245, pyrazoloazole couplers containing sulfonamido groups in their molecules described in JP-A-61-65245, pyrazoloazole couplers having alkoxyphenylsulfonamido ballast groups described in JP-A-61-

147254, pyrazolotriazole couplers each having an alkoxyl group or an aryloxy group at the 6-position described in JP-A-62-209457 or JP-A-63-307453, and pyrazolotriazole couplers having carbonamido groups in their molecules described in JP-A-2-201443.

General formulas (12) and (13) represent couplers called phenol couplers and naphthol couplers, respectively. In formulas (12) and (13), $R^{30}$ represents a hydrogen atom or a group selected from the group consisting of —$NHCOR^{32}$, —$SO_2NR^{32}R^{33}$, —$NHSO_2R^{32}$, —$NHCOR^{32}$, —$NHCONR^{32}R^{33}$ and —$NHSO_2NR^{32}R^{33}$. $R^{32}$ and $R^{33}$ each represents a hydrogen atom or a substituent. In general formulas (12) and (13), $R^{31}$ represents a substituent, p represents an integer selected from 0 to 2, and m is an integer selected from 0 to 4. Y has the same meaning as with general formulas (6) to (9). The substituents represented by $R^{31}$ to $R^{33}$ include the substituents represented by $R^{24}$ to $R^{26}$ described above.

Preferred examples of the phenol coupler represented by general formula (12) include 2-alkylamino-5-alkylphenol couplers described in U.S. Pat. Nos. 2,369,929, 2,801,171, 2,772,162, 2,895,826 and 3,772,002, 2,5-diacylaminophenol couplers described in U.S. Pat. Nos. 2,772,162, 3,758,308, 4,126,396, 4,334,011 and 4,327,173, West German Patent (OLS) 3,329,729 and JP-A-59-166956, and 2-phenylureido-5-acylaminophenol couplers described in U.S. Pat. Nos. 3,446,622, 4,333,999, 4,451,559 and 4,427,767.

Preferred examples of the naphthol coupler represented by general formula (13) include 2-carbamoyl-1-naphthol couplers described in U.S. Pat. Nos. 2,474,293, 4,052,212, 4,146,396, 4,228,233 and 4,296,200, and 2-carbamoyl-5-amido-1-naphthol couplers described in U.S. Pat. No. 4,690,889.

General formulas (14) to (17) represent couplers called pyrrolotriazole couplers. In general formulas (14) to (17), $R^{42}$, $R^{43}$ and $R^{44}$ each represents a hydrogen atom or a substituent. Y has the same meaning as in general formulas (6) to (9). The substituents represented by $R^{42}$, $R^{43}$ and $R^{44}$ include the substituents represented by $R^{24}$, to $R^{26}$ described above. Preferred examples of the pyrrolotriazole couplers represented by general formulas (14) to (17) include couplers in which at least one of $R^{42}$ and $R^{43}$ is an electron attractive group, which are described in European Patents 488,248A1, 491,197A1 and 545,300.

In addition, couplers having structures such as cyclocondensed phenol, imidazole, pyrrole, 3-hydroxypyridine, active methine, 5,5-cyclocondensed heterocycles and 5,6-cyclocondensed heterocycles can be used.

As the cyclocondensed phenol couplers, couplers described in U.S. Pat. Nos. 4,327,173, 4,564,586 and 4,904,575 can be used.

As the imidazole couplers, couplers described in U.S. Pat. Nos. 4,818,672 and 5,051,347 can be used.

As the pyrrole couplers, couplers described in JP-A-4-188137 and JP-A-190347 can be used.

As the 3-hydroxypyridine couplers, couplers described in JP-A-1-315736 can be used.

As the active methine couplers, couplers described in U.S. Pat. Nos. 5,104,783 and 5,162,196 can be used.

As the 5,5-cyclocondensed heterocyclic couplers, pyrrolopyrazole couplers described in U.S. Pat. No. 5,164,289 and pyrroloimidazole couplers described in JP-A-4-174429 can be used.

As the 5,6-cyclocondensed heterocyclic couplers, pyrazolopyrimidine couplers described in U.S. Pat. No. 4,950,585, pyrrolotriazine couplers described in JP-A-4-204730, and couplers described in European Patent 556,700 can be used.

In the present invention, besides the above-mentioned couplers, couplers can also be used which are described in West German Patents 3,819,051A and 3,823,049, U.S. Pat. Nos. 4,840,883, 5,024,930, 5,051,347 and 4,481,268, European Patents 304,856A2, 329,036, 354,549A2, 374,781A2, 379,110A2 and 386,930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732.

Examples of the couplers which can be used in the present invention are shown below, but the present invention are not, of course, limited thereto.

4-Equivalent Couplers

C-1

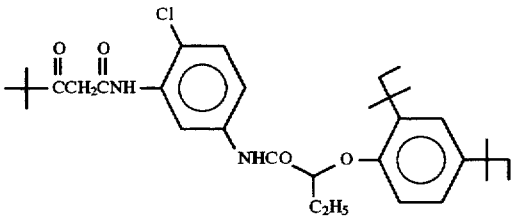

C-2

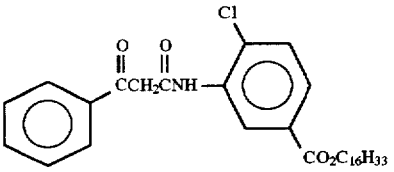

-continued
C-3
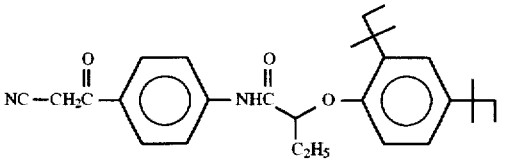
C-4
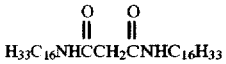
C-5
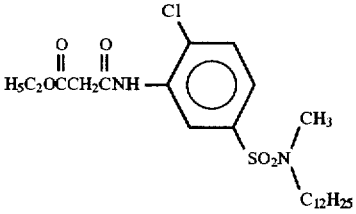
C-6
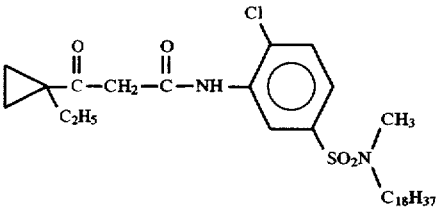
C-7
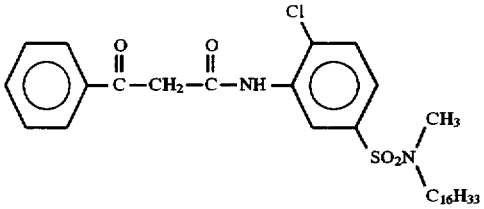
C-8
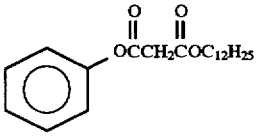
C-9
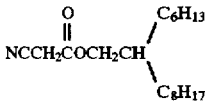
C-10
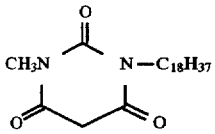
C-11
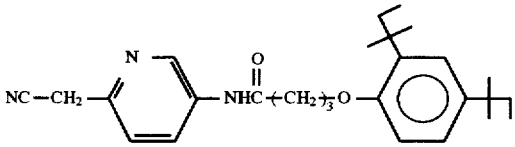
C-12
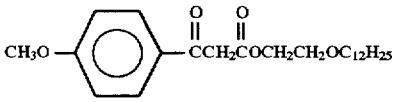

-continued
C-13
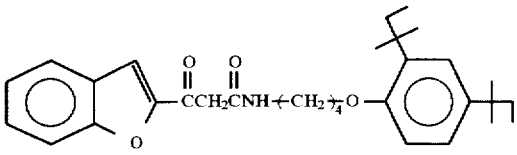
C-14
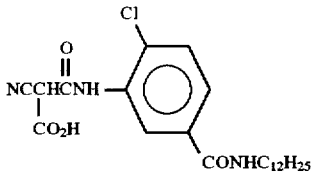
C-15
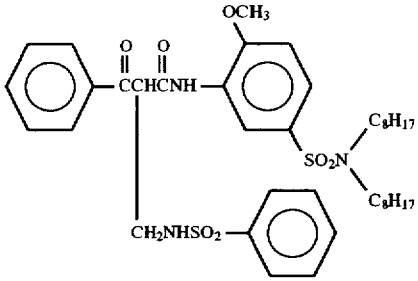
C-16
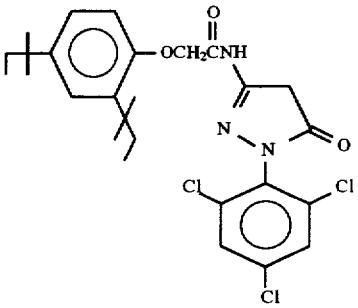
C-17
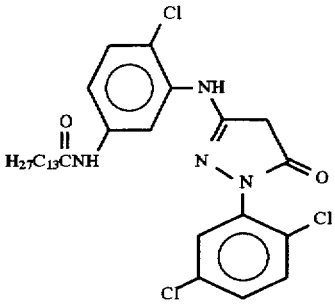
C-18
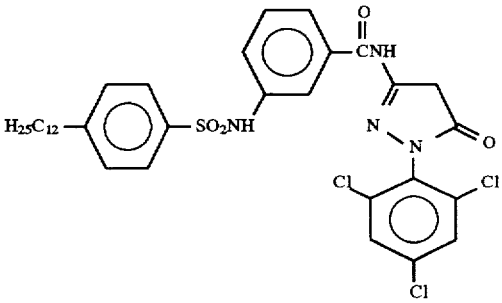

-continued
C-19
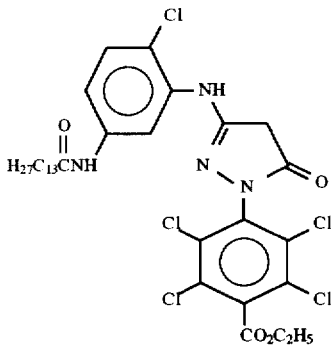
C-20
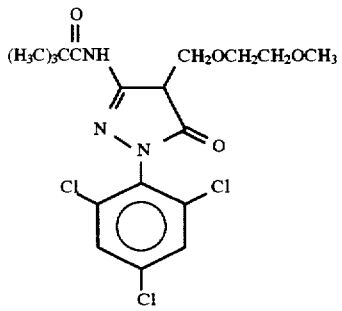
C-21
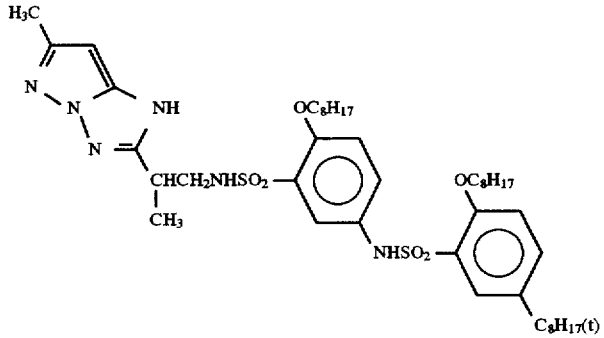
C-22
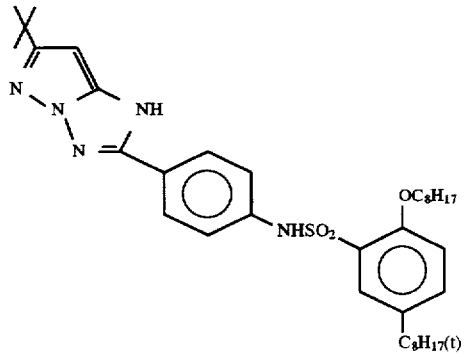

-continued
C-23
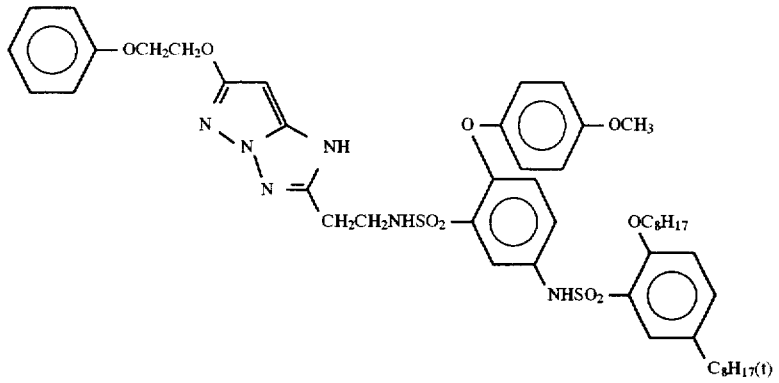
C-24
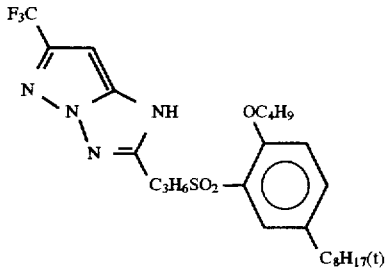
C-25
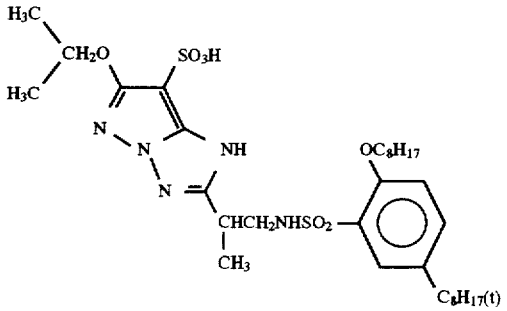
C-26
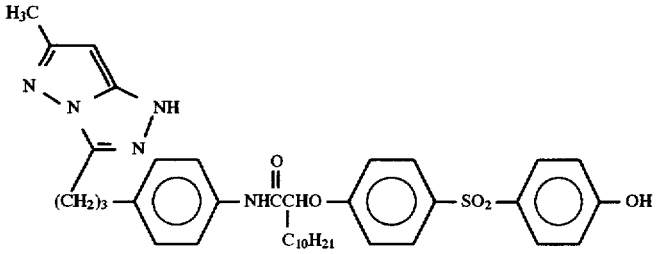

-continued
C-27
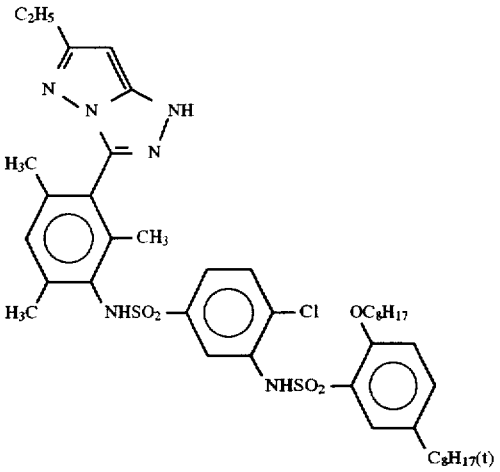
C-28
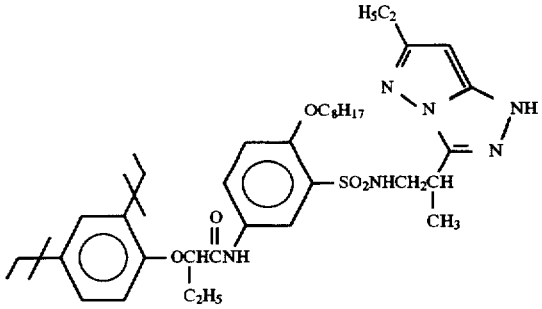
C-29
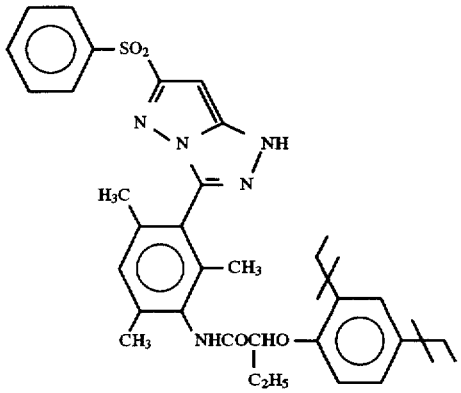
C-30
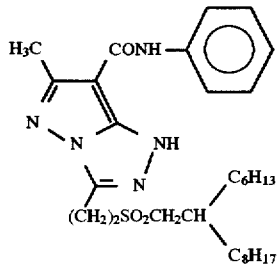

-continued
C-31
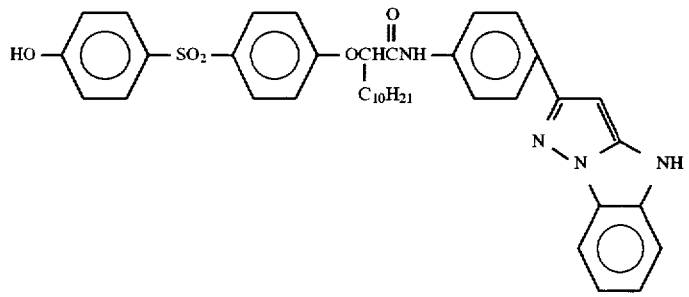
C-32
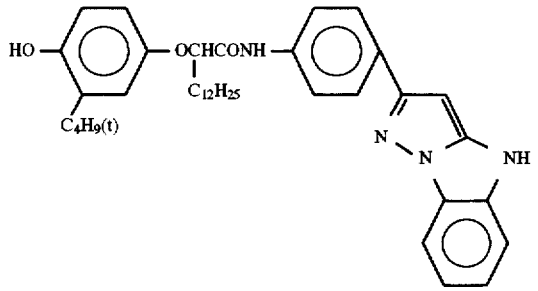
C-33
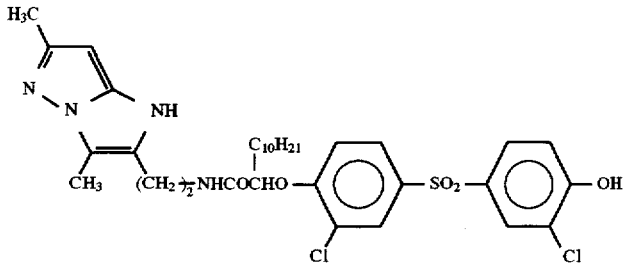
C-34
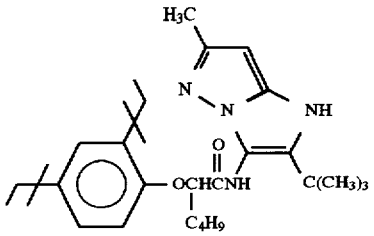
C-35
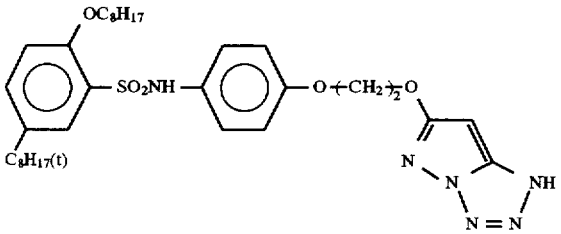
C-36
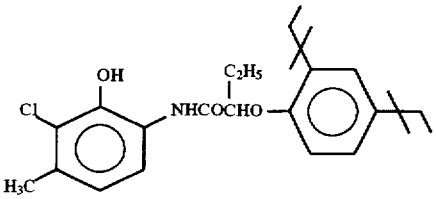

-continued
C-37
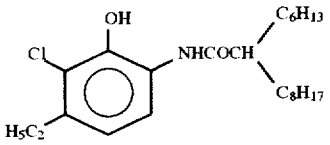
C-38
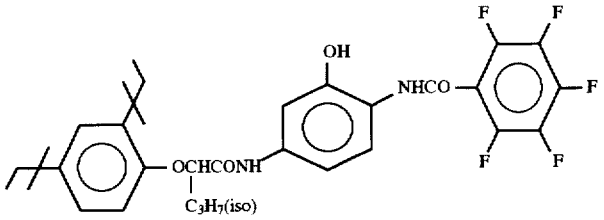
C-39
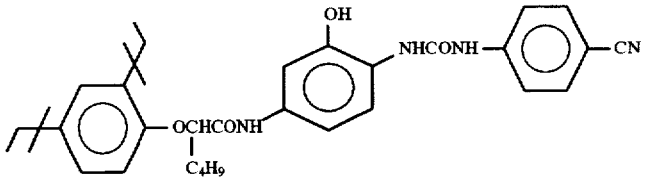
C-40
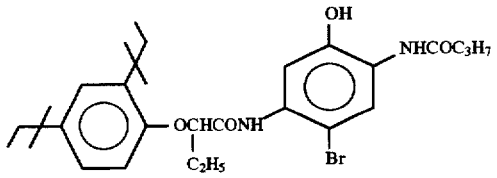
C-41
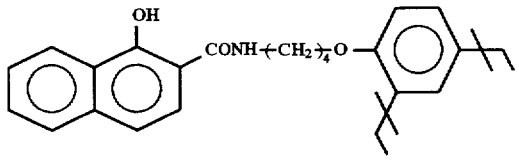
C-42
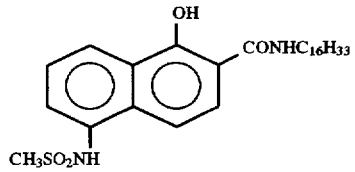
C-43
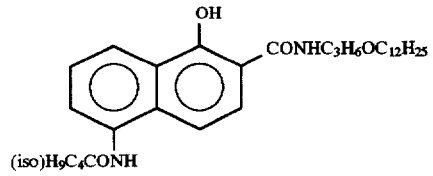
C-44
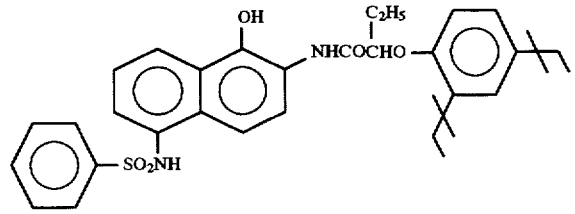
C-45
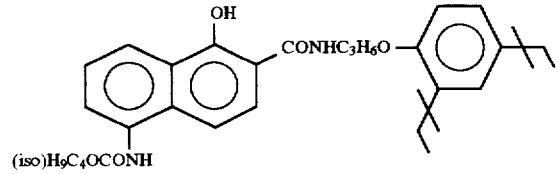

-continued
C-46
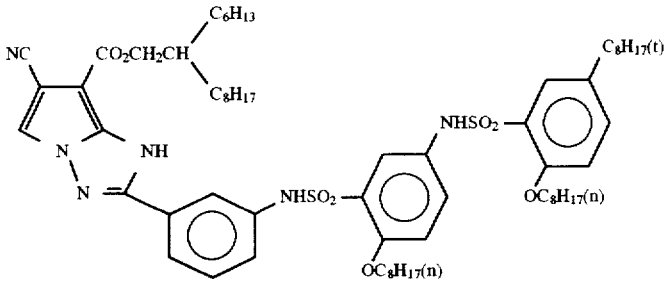
C-47
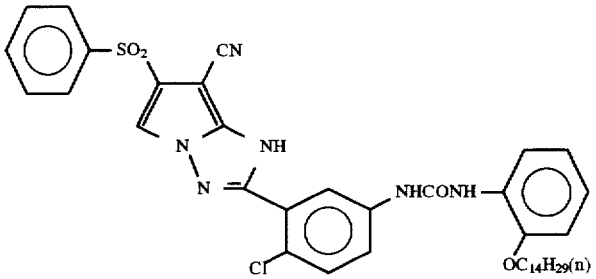
C-48
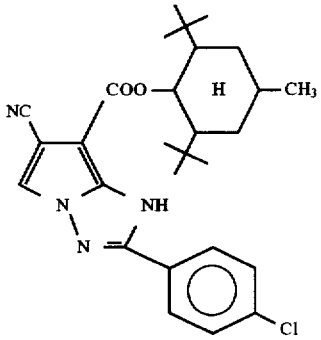
C-49
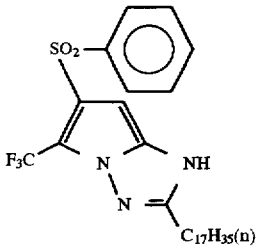
C-50
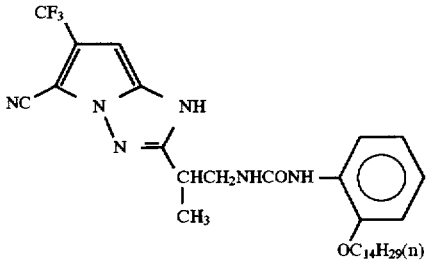

-continued
C-51
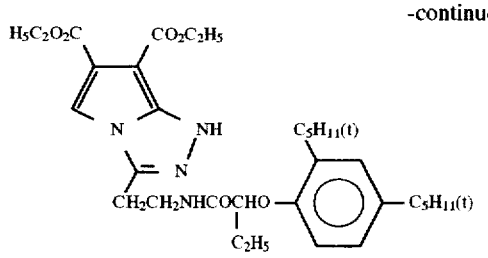
C-52
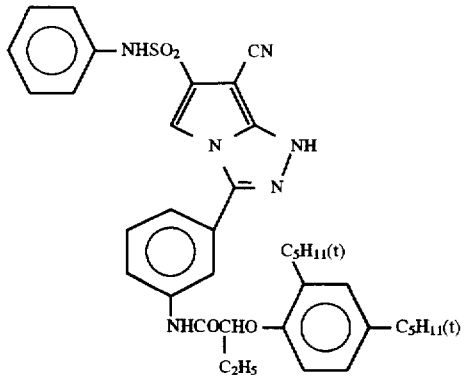
C-53
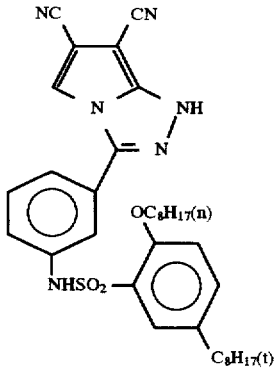
C-54
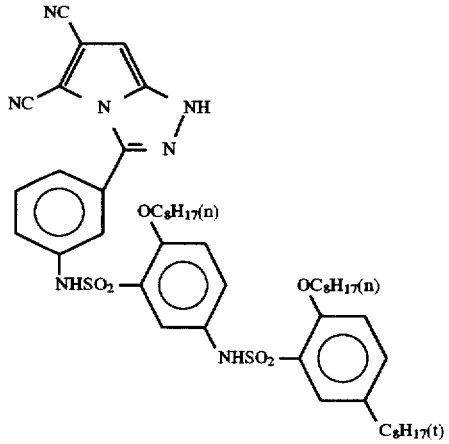
C-55
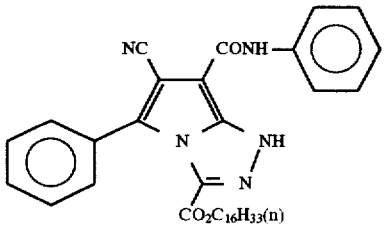

-continued
C-56
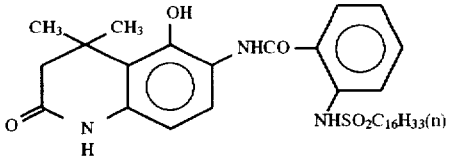
C-57
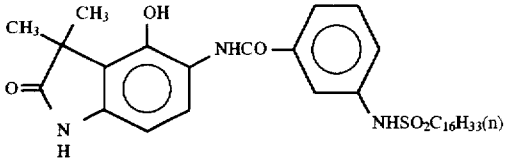
C-58
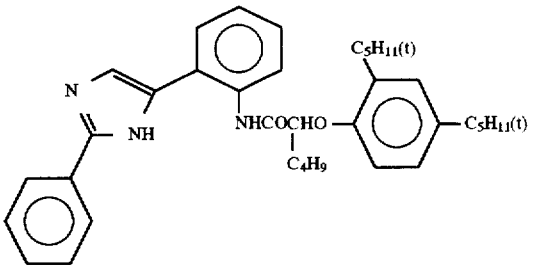
C-59
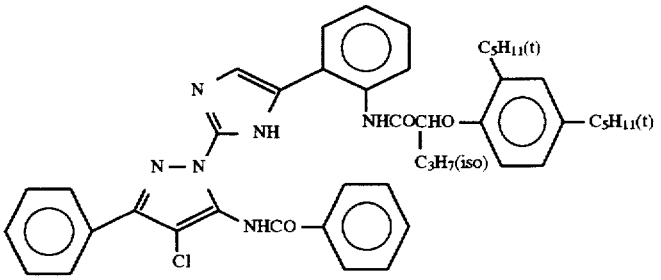
C-60
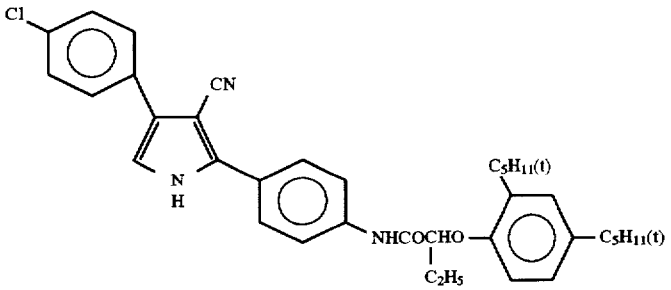
C-61
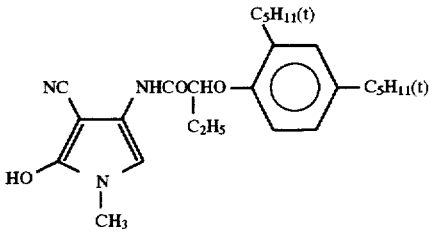
C-62
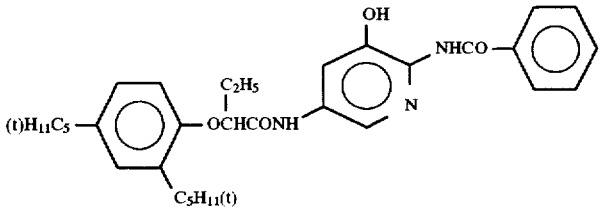

-continued
C-63
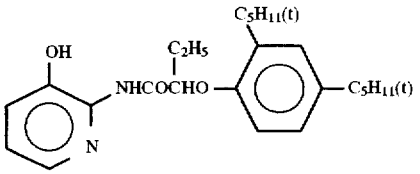
C-64
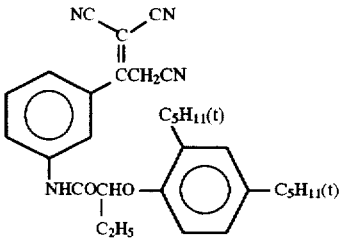
C-65
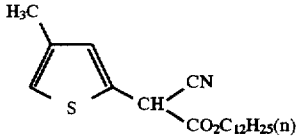
C-66
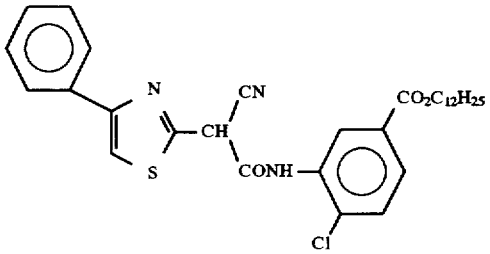
C-67
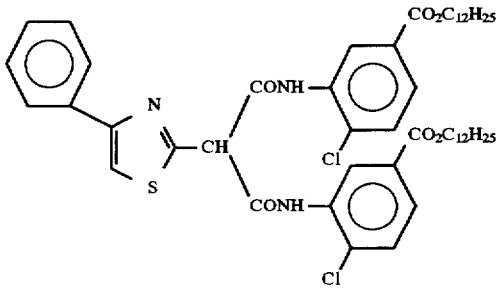
C-68
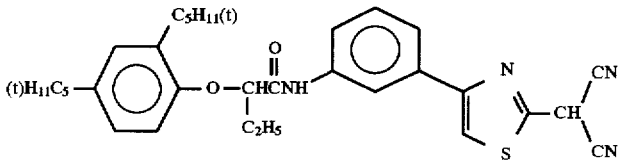
C-69
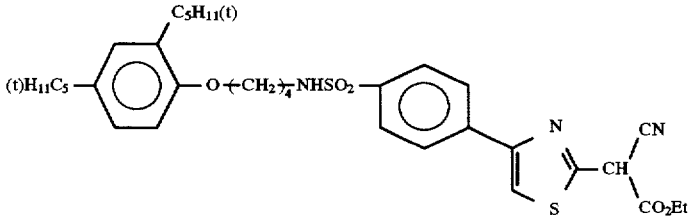

-continued
C-70
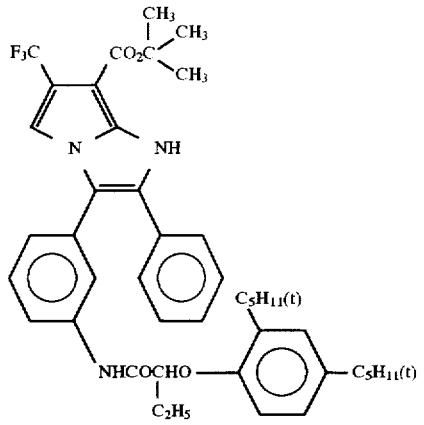
C-71
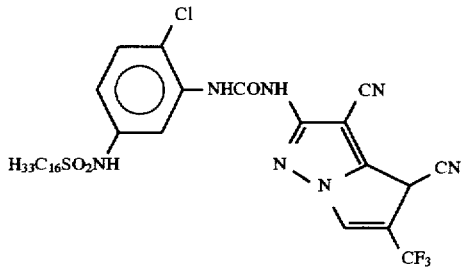
C-72
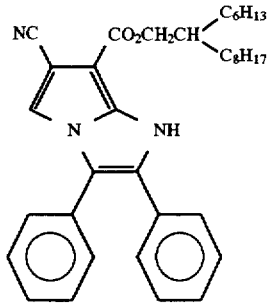
C-73
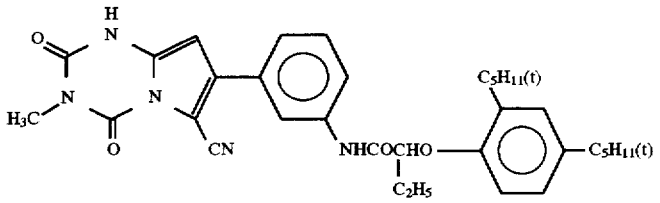
C-74
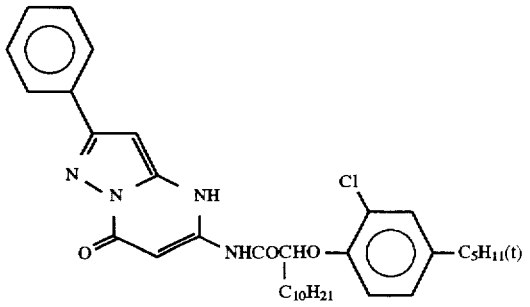

-continued
C-75
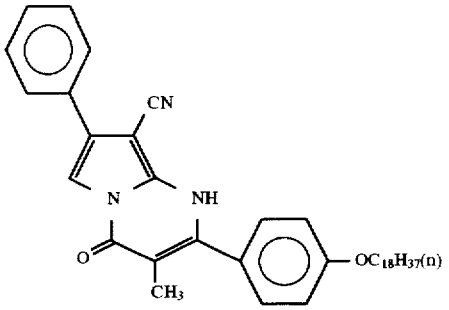
Examples of 2-Equivalent Couplers
C-76
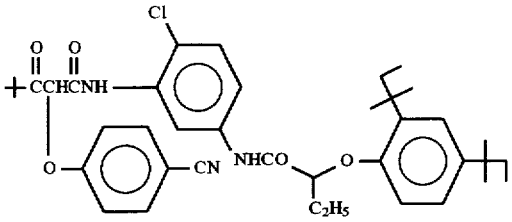
C-77
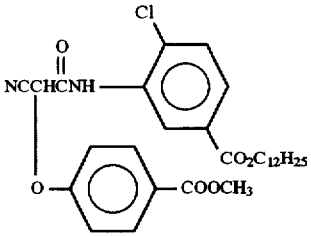
C-78
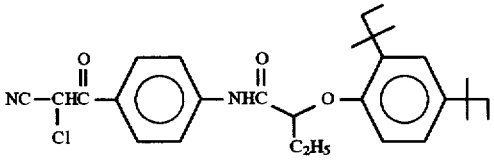
C-79
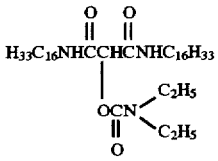
C-80
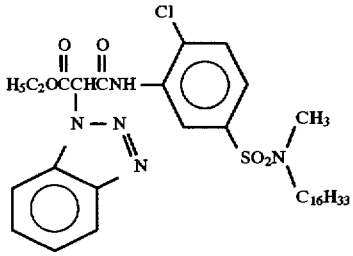
C-81
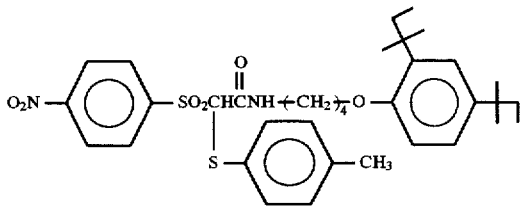

-continued
C-82
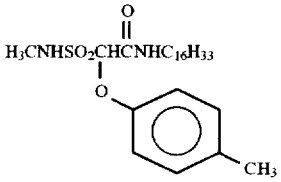
C-83
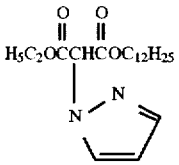
C-84
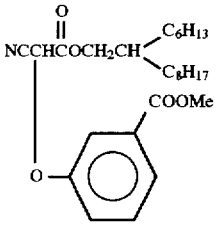
C-85
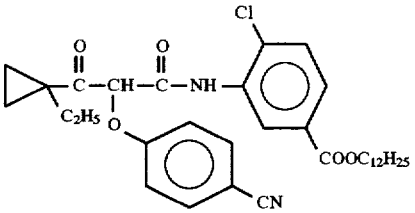
C-86
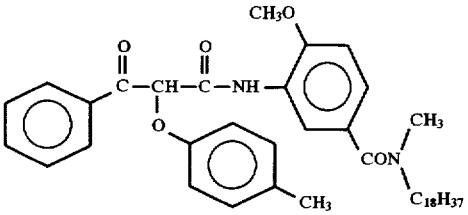
C-87
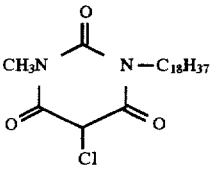
C-88
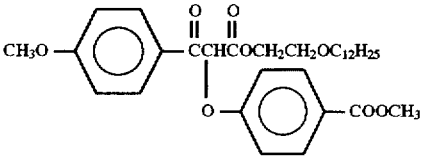
C-89
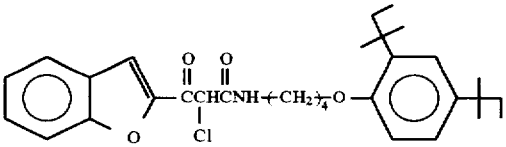

-continued
C-90
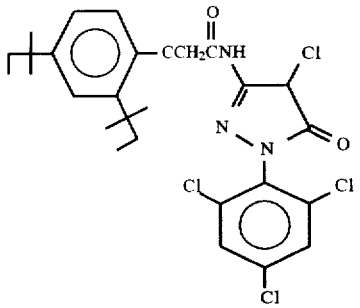
C-91
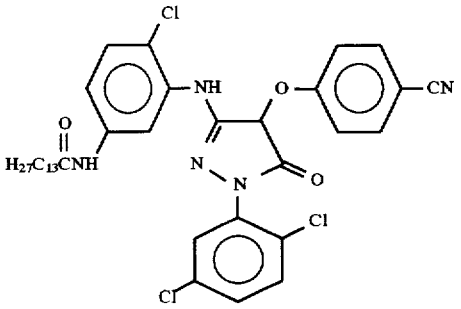
C-92
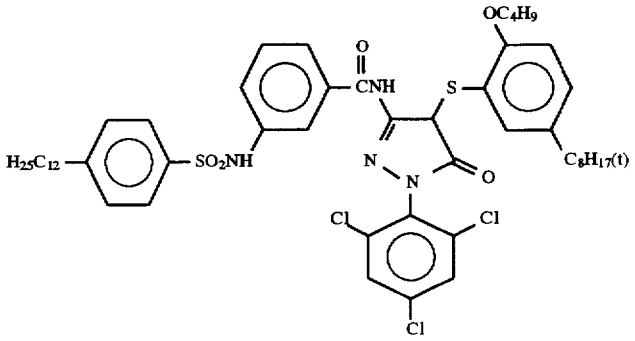
C-93
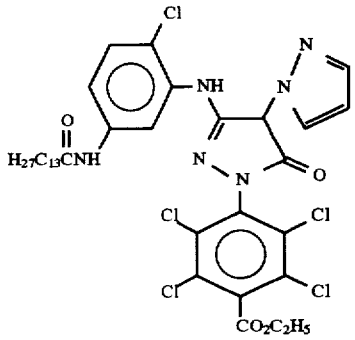
C-94
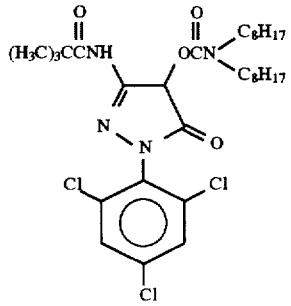

-continued
C-95
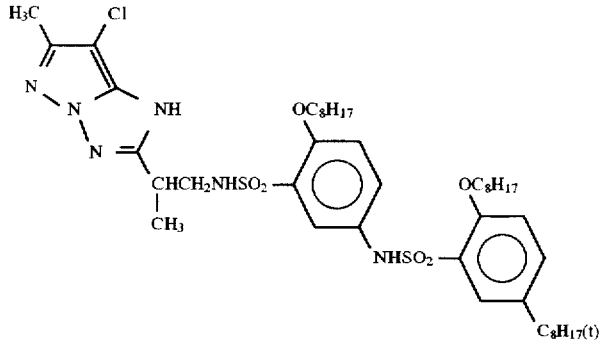
C-96
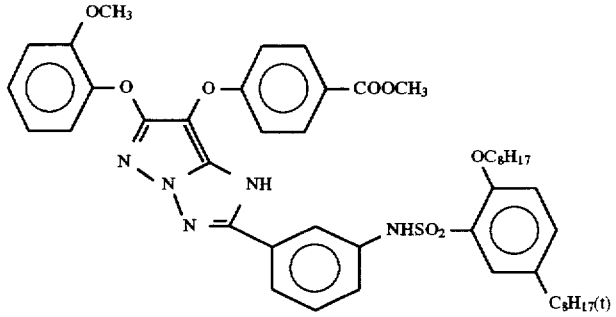
C-97
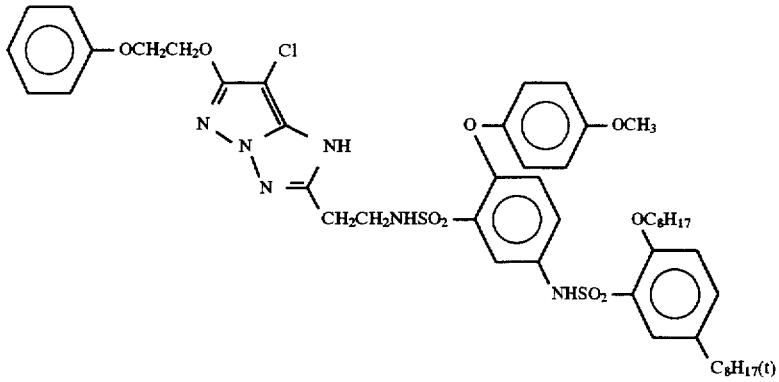
C-98
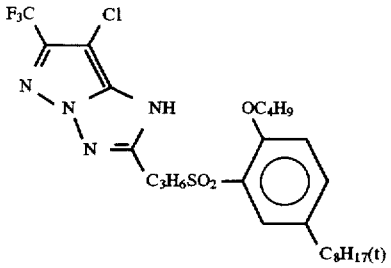
C-99
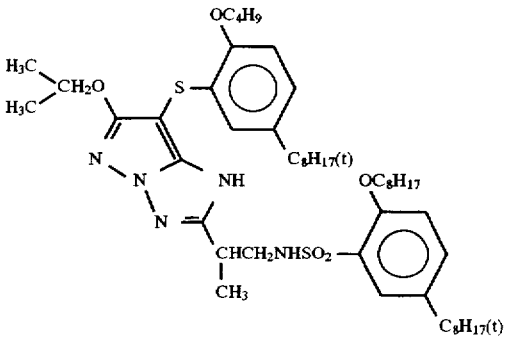

-continued
C-100
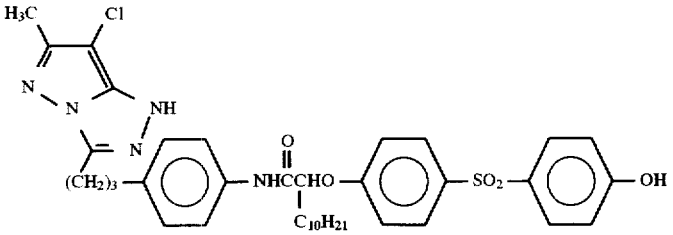
C-101
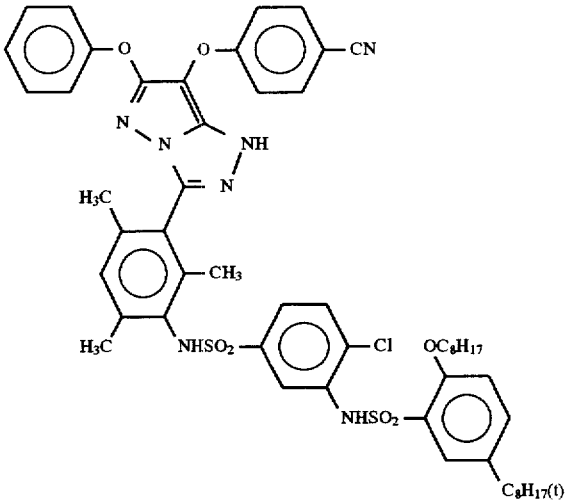
C-102
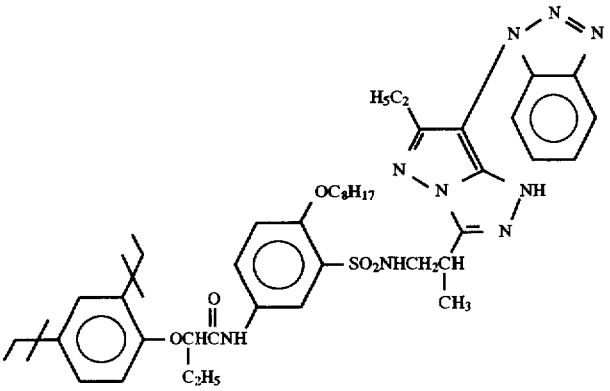
C-103
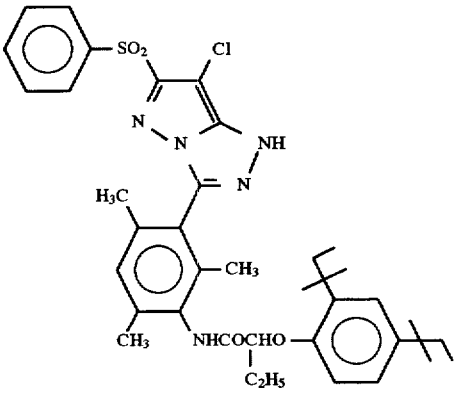

-continued
C-104
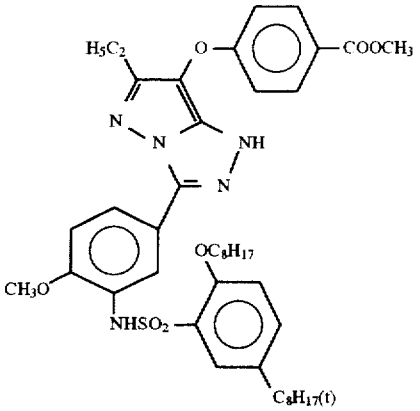
C-105
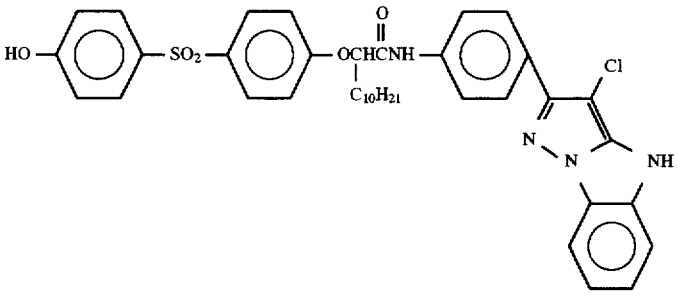
C-106
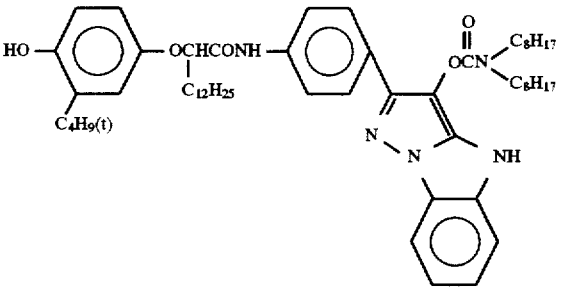
C-107
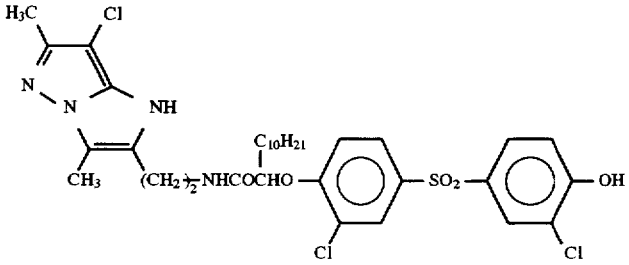
C-108
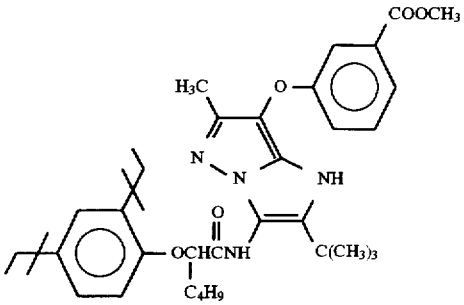

-continued
C-109
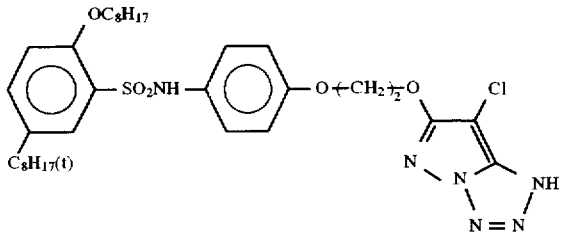
C-110
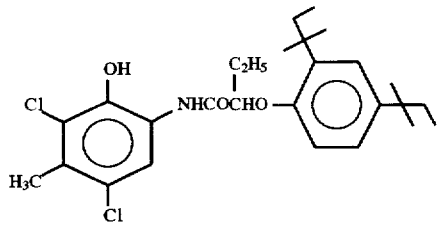
C-111
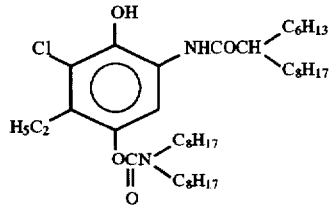
C-112
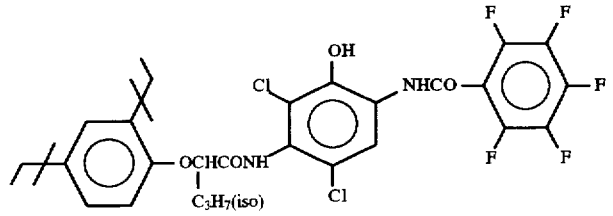
C-113
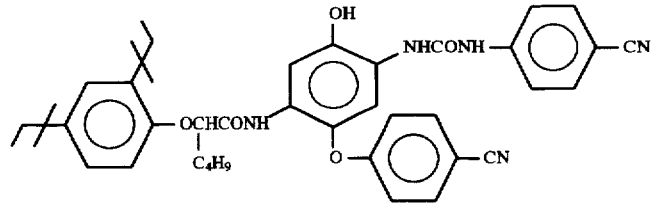
C-114
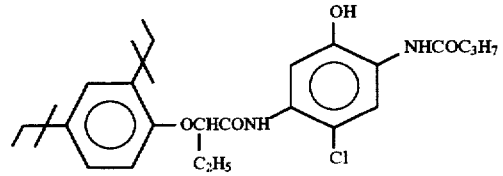
C-115
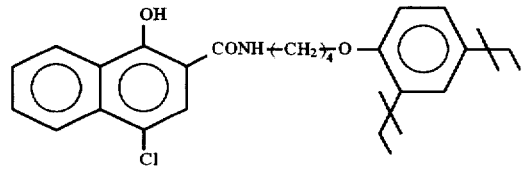

-continued
C-116
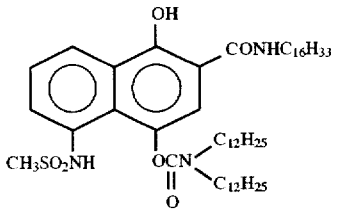
C-117
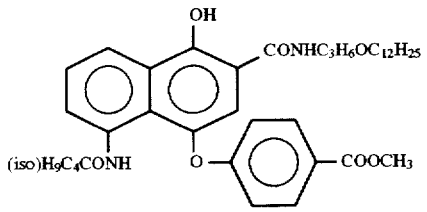
C-118
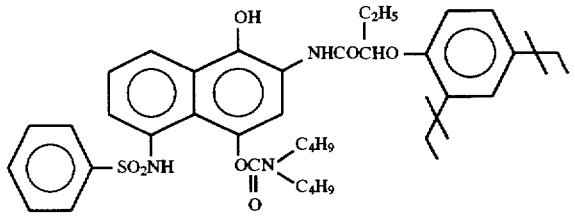
C-119
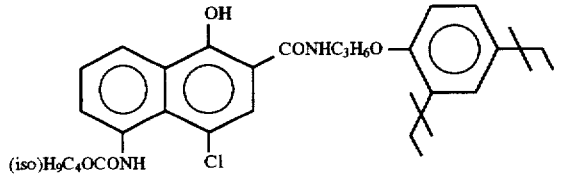
C-120
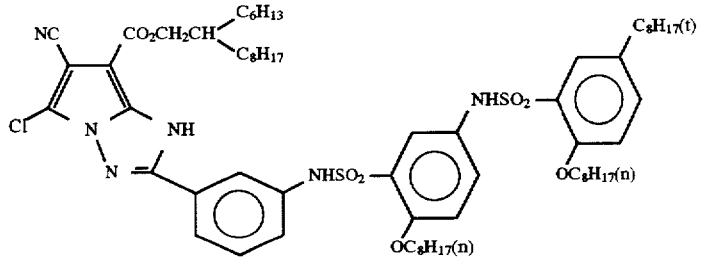
C-121
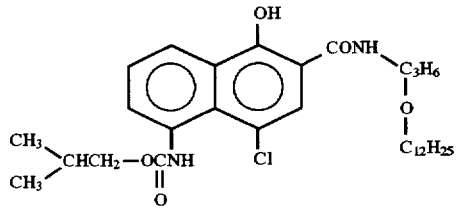
C-122
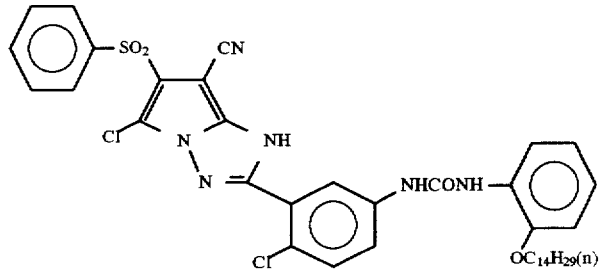

-continued
C-123
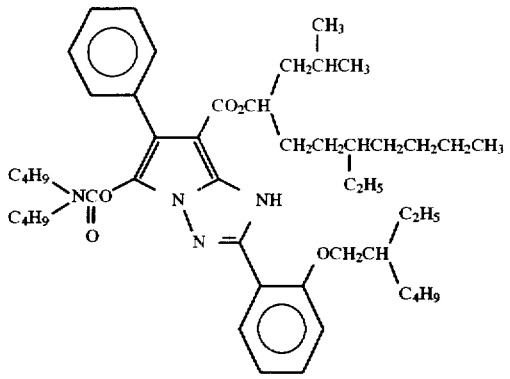
C-124
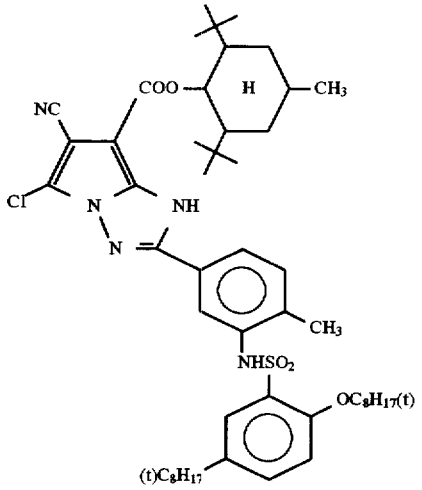
C-125
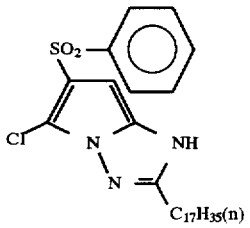
C-126
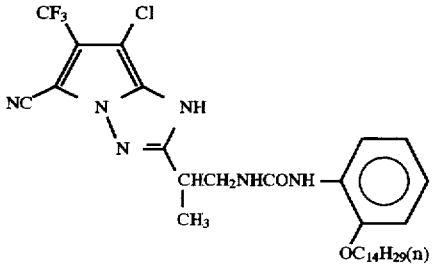
C-127
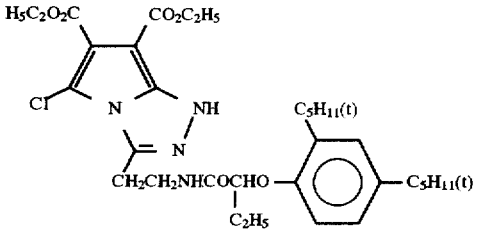

-continued
C-128
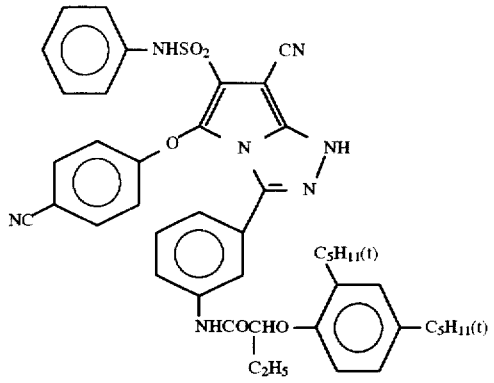
C-129
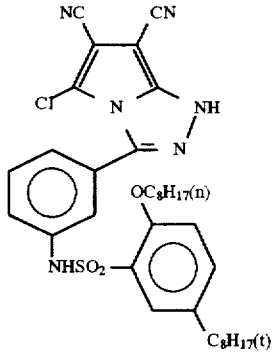
C-130
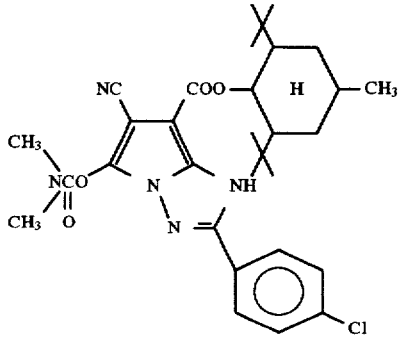
C-131
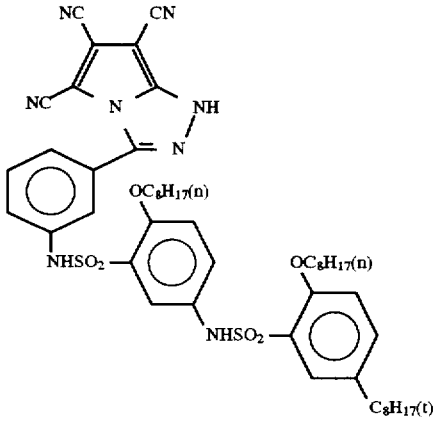

-continued
C-132
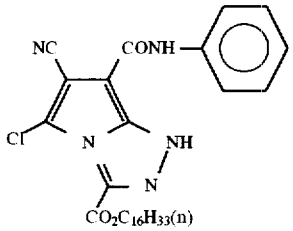
C-133
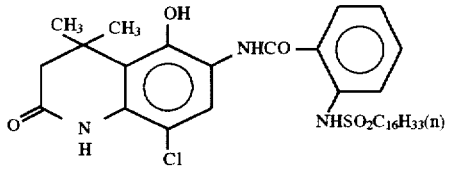
C-134
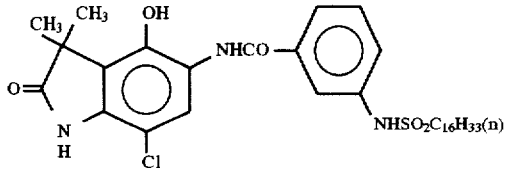
C-135
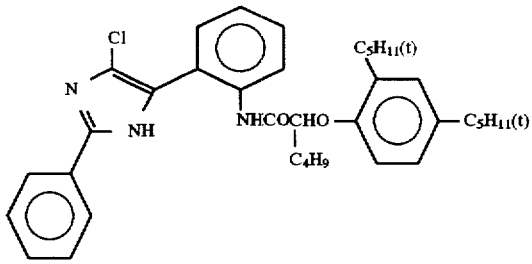
C-136
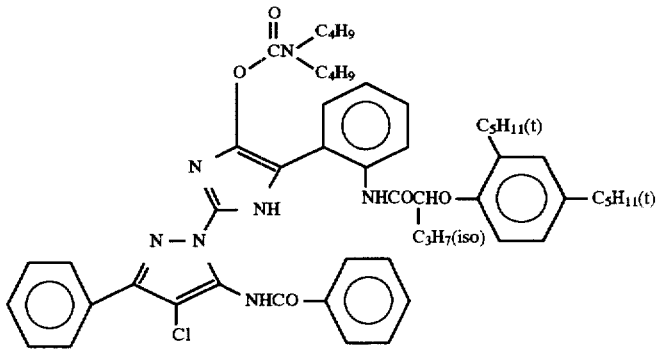
C-137
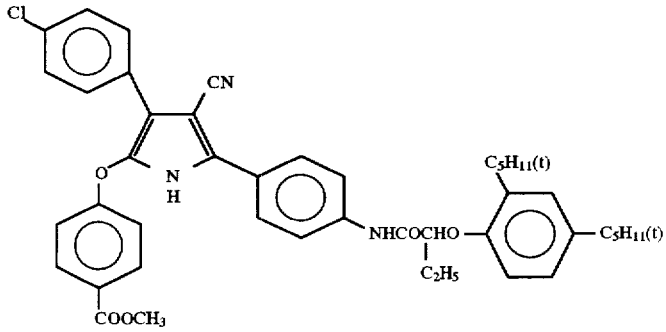

-continued
C-138
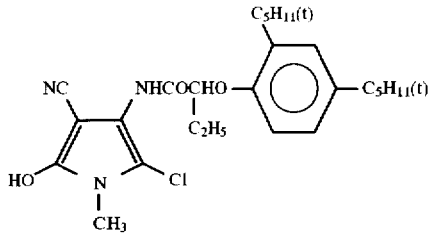
C-139
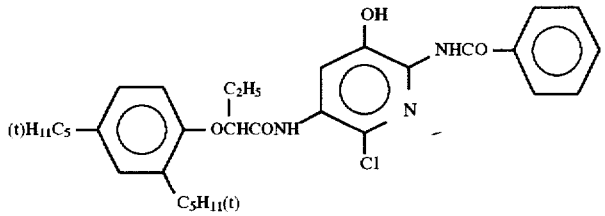
C-140
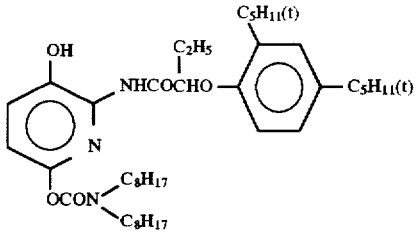
C-141
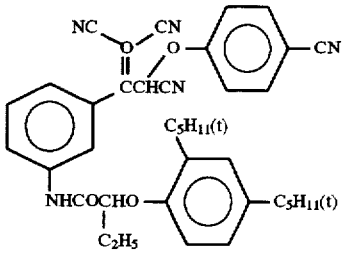
C-142
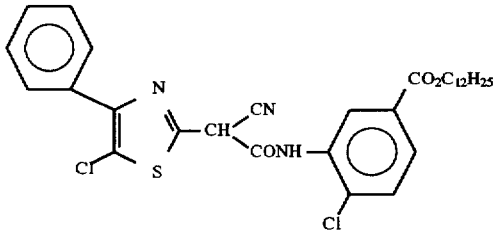
C-143
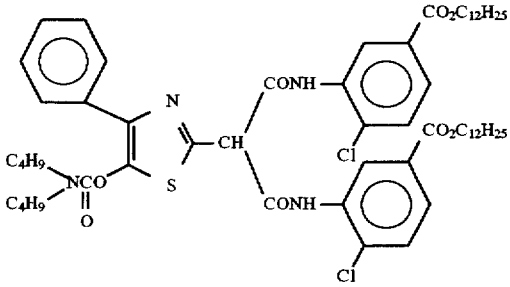

-continued
C-144
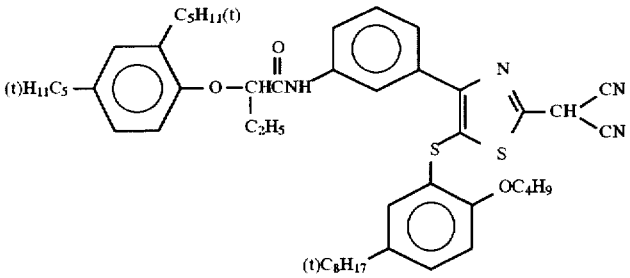
C-145
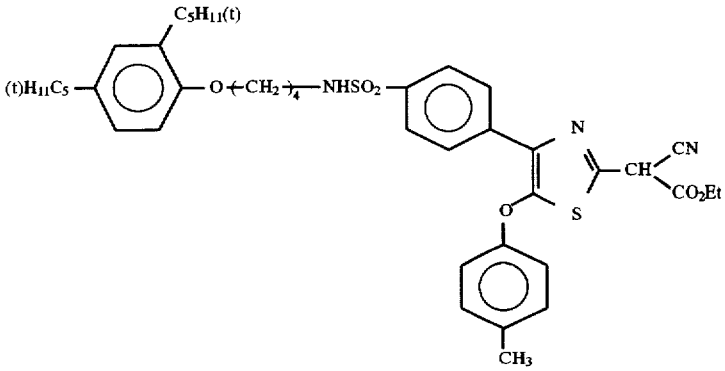
C-146
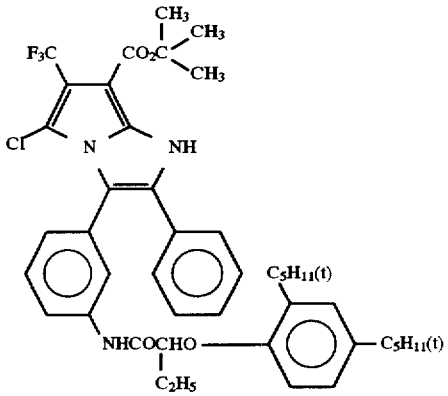
C-147
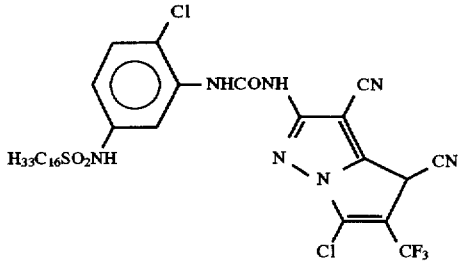
C-148
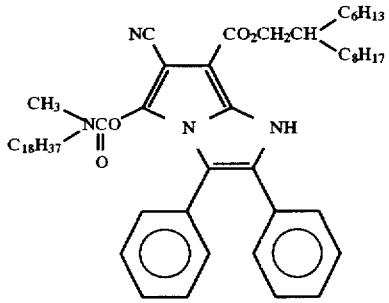

-continued
C-149
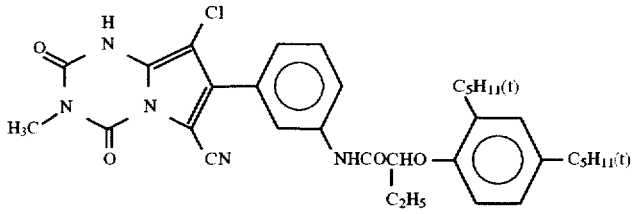
C-150
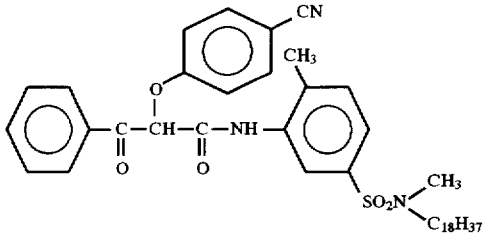
C-151
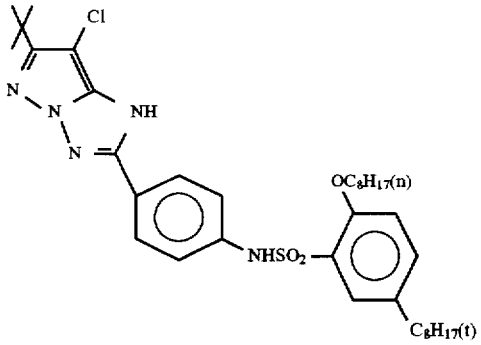
C-152
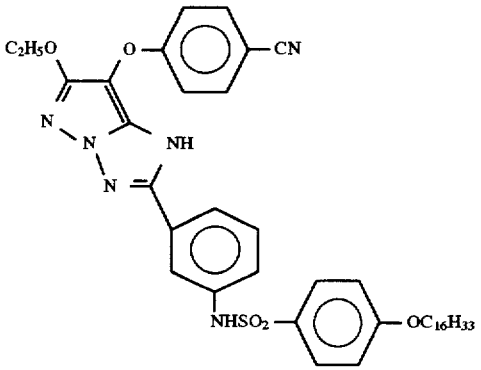
C-153
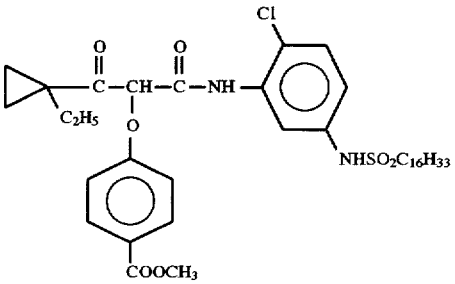

-continued
C-154
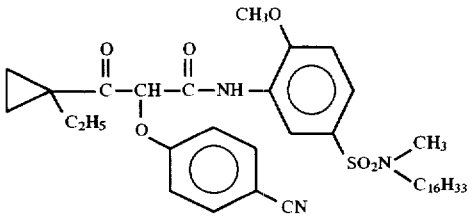
C-155
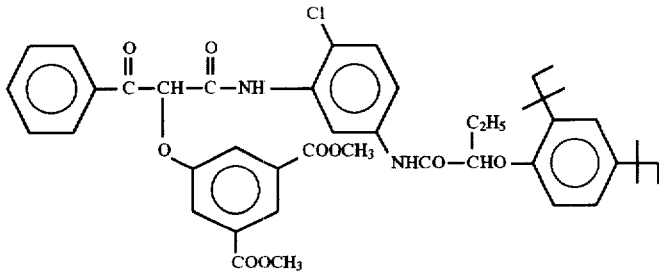
C-156
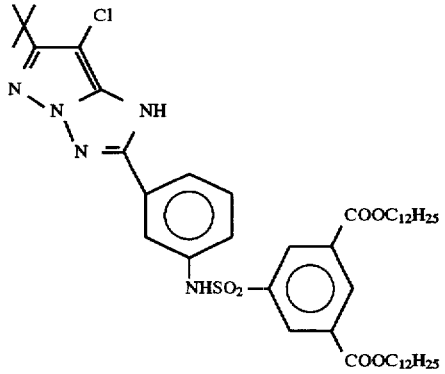
C-157
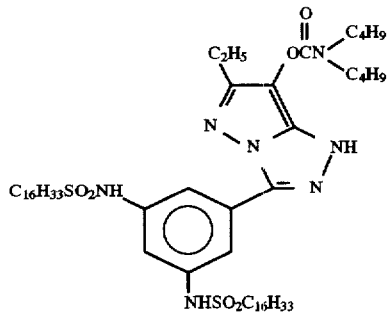
C-158
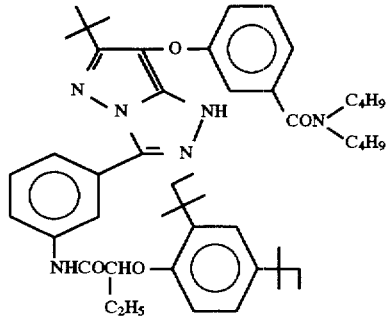

-continued
C-159
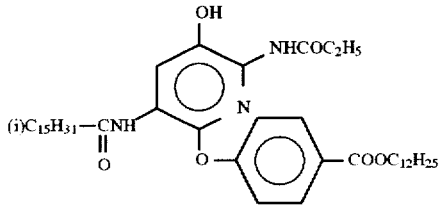
C-160
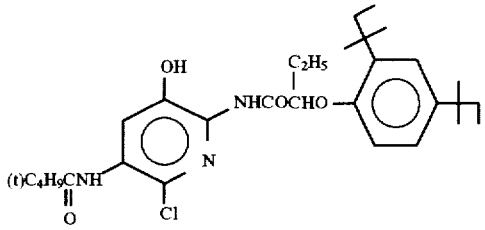
C-161
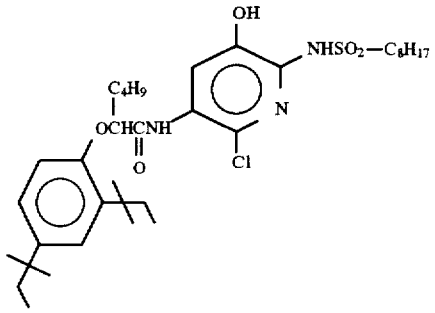
C-162
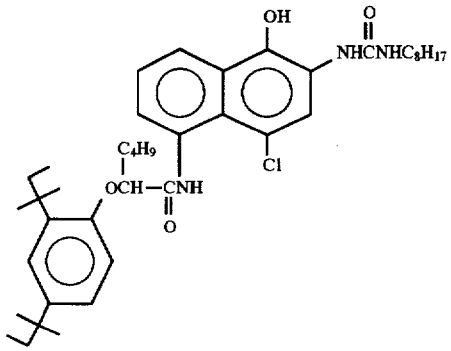
C-163
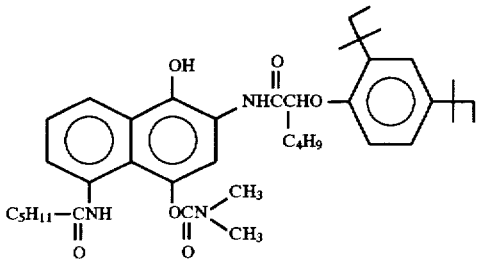
C-164
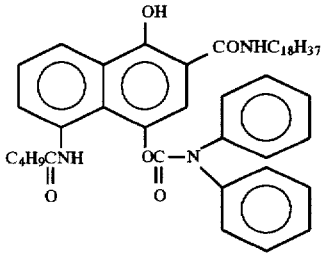

-continued
C-165
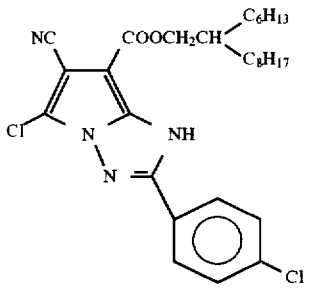
C-166
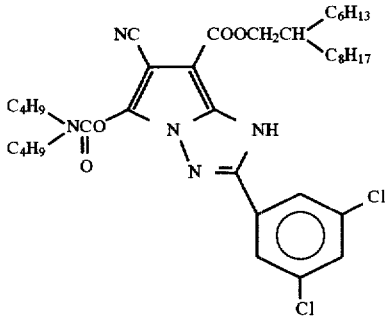
C-167
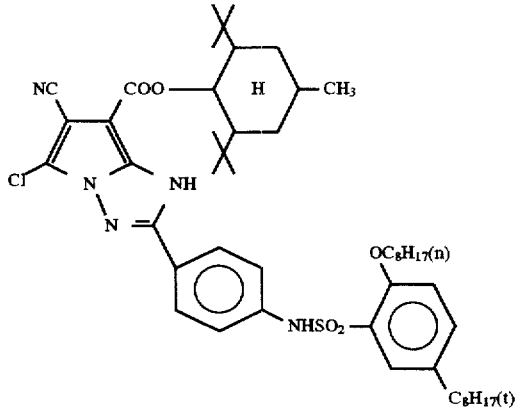
C-168
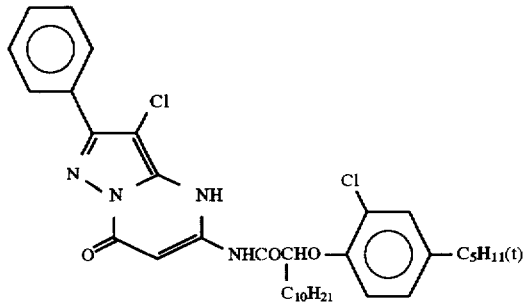

-continued

C-169

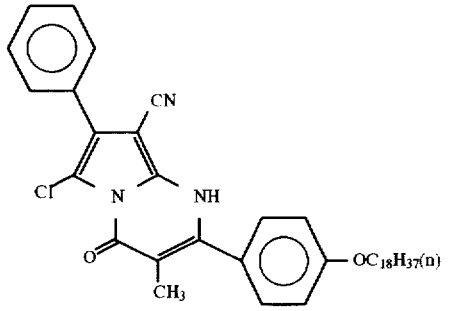

The present invention is applicable in a system not using any auxiliary developing agent such as Phenidone. In order to make development possible without use of an auxiliary developing agent, for example, treatment with a strong basic aqueous solution (for example, activator treatment using a 0.1–1N base) or heat development treatment is considered.

The developing agents and the couplers can be added by the following method. First, the developing agent, the coupler and a high boiling solvent (for example, alkyl phosphates and alkyl phthalates) are mixed, and the mixture is dissolved in a low boiling solvent (for example, ethyl acetate and methyl ethyl ketone). The resulting solution is dispersed in water by the emulsion dispersing methods known in the art. Further, it is also possible to add them by the solid dispersing method described in JP-A-63-271339.

Although the amount of the coupler added depends upon the molar absorption coefficient ($\epsilon$) thereof, in order to obtain an image density of 1.0 or more as a reflection density, it is suitably about 0.001 to about 100 mmol/m$^2$, preferably about 0.01 to about 10 mmol/m$^2$, and more preferably about 0.05 to about 5 mmol/m$^2$ as the amount of the couplers coated, when the couplers produce dyes having a molar absorption coefficient ($\epsilon$) of about 5,000 to about 500,000 by coupling.

The developing agents can be added in a wide range of amounts, but is preferably added in a 0.01- to 100-fold molar excess in relation to the coupler, and more preferably in a 0.1- to 10-fold molar excess.

The color photographic martial of the present invention basically has a light-sensitive silver halide, a coupler as a dye donating compound, a reducing agent and a binder on a support and can further contain an organic metal salt oxidizing agent, etc. if necessary. These components are added to the same layer in many cases. However, they can be divided to add them to separate layers as long as they are in a reactive state.

In order to obtain a wide range of colors on the chromaticity diagram using the three primary colors of yellow, magenta and cyan, at least three silver halide emulsion layers each having light sensitivity in different spectrum regions are used in combination. For example, a combination of the three layers of a blue-sensitive layer, a green-sensitive layer and a red-sensitive layer, or a combination of a green-sensitive layer, a red-sensitive layer and an infrared-sensitive layer is used. The respective layers can be variously disposed in order as known in the usual color photographic materials. Further, each of these respective light-sensitive layers may be divided into two or more layers if necessary.

The photographic materials can be provided with various auxiliary layers such as a protective layer, an undercoat layer, an intermediate layer, an antihalation layer and a back layer. Further, in order to improve color separation, various filter dyes can also be added.

A silver halide emulsion which can be Used in the present invention may be any of silver chloride, silver bromide, silver iodobromide, silver chlorobromide, silver chloroiodide and silver chloroiodobromide.

The silver halide emulsions which can be used in the present invention may be either a surface latent image type emulsions or an internal latent image type emulsion. The internal latent image type emulsion can be used as a direct reversal emulsion in combination with a nucleating agent or light fogging. Further, a so-called core/shell emulsion in which the insides of grains are different from the surfaces thereof in the phase may be used, and silver halides different in composition may be joined by epitaxial junction. Further, the silver halide emulsion may be either a monodisperse emulsion or a polydisperse emulsion, and methods are preferably used in which monodisperse emulsions are mixed to adjust gradation as described in JP-A-1-167743 and JP-A-4-223463. The grain size is preferably from 0.1 to 2 μm, and more preferably from 0.2 to 1.5 μm. The crystal habit of the silver halide grains may be any of a regular crystal form such as a cubic, an octahedral or a tetradecahedral form, an irregular crystal form such as a spherical form or a plate (tabular) form high in aspect ratio, a form having a crystal defect such as a twin plane, and a combined form thereof.

Specifically, any of silver halide emulsions can be used which are prepared by methods described in U.S. Pat. No. 4,500,626, column 50, U.S. Pat. No. 4,628,021, *Research Disclosure* (hereinafter abbreviated as "RD"), No. 17029 (1978), ibid., No. 17643, pages 22 and 23 (December, 1978), ibid., No. 18716, page 648 (November, 1979), ibid., No. 307105, pages 863–865 (November, 1989), JP-A-62-253159, JP-A-64-13546, JP-A-2-236546, JP-A-3-110555, P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

In the course of preparation of the light-sensitive silver halide emulsion of the present invention, so-called salt removal for removing excess salts is preferably conducted. As means for this, a noodle water washing method in which gelatin is gelated can be used, and precipitation methods may also be used utilizing a poly-valent anionic inorganic salt (for example, sodium sulfate), an anionic surfactant, an anionic polymer (for example, sodium polystyrenesulfonate) or a gelatin derivative (for example, aliphatic acylated gelatin, aromatic acylated gelatin and aromatic carbamoylated gelatin). The precipitation methods are preferably used.

For various purposes, the light-sensitive silver halide emulsion may contain a heavy metal such as iridium, rhodium, platinum, cadmium, zinc, thallium, lead, iron and osmium. These metals may be used alone or in combination. The amount added is generally about $10^{-9}$ to $10^{-3}$ mole per mole of silver halide, although it depends on the purpose of use. They may be uniformly added to grains or localized in the insides or surfaces of grains. Specifically, emulsions described in JP-A-2-236542, JP-A-1-116637 and JP-A-5-181246 are preferably used.

In the grain forming stage of the light-sensitive silver halide emulsion of the present invention, rhodanides, ammonia, 4-substituted thioether compounds, organic thioether derivatives described in JP-B-47-11386 (the term "JP-B" as used herein means an "examined Japanese patent publication") or sulfur-containing compounds described in JP-A-53-144319 can be used as a silver halide solvent.

For other conditions, reference can be made to the descriptions of P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) which are described above. That is, any of an acid process, a neutral process and an ammonia process may be used. A soluble silver salt and a soluble halogen salt may be reacted with each other by using any of a single jet process, a double jet process and a combination thereof. In order to obtain monodisperse emulsions, the double jet process is preferably used.

A reverse mixing process in which grains are formed in the presence of excess silver ions can also be used. As a type of double jet process, a process for maintaining constant the pAg in a liquid phase forming a silver halide, namely a so-called controlled double jet process, can also be used.

In order to accelerate the growth of grains, the concentration, the amount and the rate of silver salts and halogen salts added may be increased (JP-A-55-142329, JP-A-55-158124 and U.S. Pat. No. 3,650,757).

Further, reaction solutions may be stirred by any of the known stirring methods. The temperature and the pH of the reaction solution during formation of silver halide grains may be arbitrarily selected depending on the purpose. The pH range is preferably 2.2 to 8.5, and more preferably 2.5 to 7.5.

Light-sensitive silver halide emulsions are usually chemically sensitized. For chemical sensitization of the light-sensitive silver halide emulsion of the present invention, chalcogen sensitization such as sulfur sensitization, selenium sensitization or tellurium sensitization, noble metal sensitization using gold, platinum, palladium, etc. and reduction sensitization which are known in the emulsions for ordinary type photographic materials can be used alone or in combination (for example, JP-A-3-110555 and JP-A-5-241267). Such chemical sensitization can also be conducted in the presence of a nitrogen-containing heterocyclic compound (JP-A-62-253159). Further, an antifoggant set out below can be added after chemical sensitization. Specifically, methods described in JP-A-5-45833 and JP-A-62-40446 can be used.

The pH on chemical sensitization is preferably 5.3 to 10.5, and more preferably 5.5 to 8.5, and the pAg is preferably 6.0 to 10.5, and more preferably 6.8 to 9.0.

The coated amount of the light-sensitive silver halide emulsions used in the present invention is preferably 1 mg to 10 g/m$^2$ in terms of silver.

In order to give the color sensitivities of green, red and infrared sensitivities to the light-sensitive silver halide emulsion used in the present invention, the light-sensitive silver halide emulsions are spectrally sensitized with methine dyes or the like. Further, spectral sensitization of a blue region may be applied to a blue-sensitive emulsion as needed.

The dyes used include cyanine dyes, merocyantne dyes, complex cyanine dyes, complex merocyanine dyes, holopolarcyanine dyes, hemicyanine dyes, styryl dyes and hemioxanol dyes.

Specifically, they include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for supersensitization and wavelength adjustment of spectral sensitivity.

The emulsions may contain dyes having no color sensitization themselves or compounds which do not substantially absorb visible light and exhibit supersensitization, in combination with the sensitizing dyes (for example, ones described in U.S. Pat. No. 3,615,641 and JP-A-63-23145).

These sensitizing dye may be added to the emulsion during chemical ripening, before or after it, or before or after nucleation of the silver halide grains according to U.S. Pat. Nos. 4,183,756 and 4,225,566. The sensitizing dye and supersensitizer may be added in the form of a solution in an organic solvent such as methanol, a dispersion in gelatin or a solution of a surfactant. The sensitizing agent can be generally added in an amount of from about $10^{-8}$ to about $10^{-2}$ mole per mole of silver halide.

Additives used in such processes and known photographic additives which can be used in the heat developable photographic materials and dye fixing materials of the present invention are described in RD, No. 17643, ibid., No. 18716 and ibid., No. 307105 described above and corresponding portions thereof are summarized in the following table.

| Type of Additives | RD17643 | RD18716 | RD307105 |
|---|---|---|---|
| 1. Chemical Sensitizers | p. 23 | p. 648, right column | p. 866 |
| 2. Sensitivity Increasing Agents | | p. 648, right column | |
| 3. Spectral Sensitizers, Supersensitizers | pp. 23–24 | p. 648, right column to p. 649, right column | pp. 866–868 |
| 4. Fluorescent Brightening Agents | p. 24 | p. 648, right column | p. 868 |
| 5. Antifoggants, Stabilizers | pp. 24–25 | p. 649, right column | pp. 868–870 |
| 6. Light Absorbers, Filter dyes, UV Absorbers | pp. 25–26 | p. 649, right column to p. 650, left column | p. 873 |
| 7. Dye Image Stabilizers | p. 25 | p. 650, left column | p. 872 |
| 8. Hardeners | p. 26 | p. 651, left column | pp. 874–875 |
| 9. Binders | p. 26 | p. 651, left column | pp. 873–874 |
| 10. Plasticizers, Lubricants | p. 27 | p. 650, right column | p. 876 |
| 11. Coating Aids, Surfactants | pp. 26–27 | p. 650 right column | pp. 875–876 |
| 12. Antistatic Agents | p. 27 | p. 650 right column | pp. 876–877 |
| 13. Matte Agents | | | pp. 878–879 |

As the binders for the layers constituting the heat developable photographic materials, hydrophilic binders are preferably used. Examples thereof include binders described in Research Disclosures stated above and JP-A-64-13546, pages 71 to 75. Specifically, transparent or translucent hydrophilic binders are preferred, and examples thereof include natural compounds such as proteins (for example, gelatin and gelatin derivatives) and polysaccharides (for example, cellulose derivatives, starch, gum arabic, dextran and pullulan), and synthetic polymers such as polyvinyl alcohol, polyvinylpyrrolidone and polyacrylamide. Further, high water-absorptive polymers described in U.S. Pat. No. 4,960,681 and JP-A-62-245260, namely homopolymers of vinyl monomers having -COOM or —$SO_3M$ (wherein M represents a hydrogen atom or an alkali metal), or copolymers of these vinyl monomers with each other or with other monomers (for example, sodium methacrylate, ammonium methacrylate and Sumikagel L-5H manufactured by Sumitomo Chemical Co, Ltd.), can also be used. These binders can be used in combination. In particular, combinations of gelatin and the above-mentioned binders are preferred. Gelatin is selected from lime-treated gelatin, acid-treated gelatin and so-called delimed gelatin reduced in content of calcium, etc., depending on various purposes, and they are also preferably used in combination.

In the present invention, an organic metal salt can also be used as an oxidizing agent in combination with the light-sensitive silver halide emulsion. As the organic metal salt, an organic silver salt is particularly preferably used.

Organic compounds which can be used for formation of the above-mentioned organic silver salt oxidizing agent include benzotriazole compounds, fatty acids and other compounds described in U.S. Pat. No. 4,500,626, columns 52 and 53. Silver acetylide described in U.S. Pat. No. 4,775,613 is also useful. Two or more of the organic silver salt may be used in combination.

The organic silver salt can be used generally in an amount of 0.01 to 10 moles per mole of light-sensitive silver halide, and preferably in an amount of 0.01 to 1 mole. The total coated amount of the light-sensitive silver halide emulsion and the organic silver salt is generally from 0.05 to 10 $g/m^2$ in terms of silver, and preferably from 0.1 to 4 $g/m^2$.

In the heat developable photographic materials of the present invention, a compound for activating development and stabilizing an image can be used. Preferred examples of the compound include those described in U.S. Pat. No. 4,500,626, columns 51 and 52. Further, compounds which can fix silver halides as described in Japanese Patent Application No. 6-206331 can also be used.

The hardener which can be used in the layers constituting the heat developable photographic materials include hardeners described in Research Disclosures stated above, U.S. Pat. Nos. 4,678,739, column 41, and 4,791,042, JP-A-59-116655, JP-A-62-245261, JP-A-61-18942, JP-A-4-218044, etc. More specifically, examples thereof include aldehyde hardeners (such as formaldehyde), aziridine hardeners, epoxy hardeners, vinyl sulfone hardeners (such as N,N'-ethylene-bis (vinylsulfonylacetamido)ethane), N-methylol hardeners (dimethylolurea) and polymer hardeners (compounds described in JP-A-62-234157) .

The hardener can be used generally in an amount of 0.001 to 1 g, preferably 0.005 to 0.5 g, per g of gelatin coated. It may be added to any of the layers constituting the photographic materials or dye fixing materials, and may be added to two or more layers.

In the layers constituting the heat developable photographic material, various antifoggants or photographic stabilizers and precursors thereof can be used. Examples thereof include compounds described in Research Disclosures stated above, U.S. Pat. Nos. 5,089,378, 4,500,627 and 4,614,702, JP-A-64-13546, pages 7–9, 57–71 and 81–97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, RD, 17643 (1978), pages 24 and 25, etc.

These compounds are preferably used in an amount of $5\times10^{-6}$ to $1\times10^{-1}$ mole per mole of silver, and more preferably in an amount of $1\times10^{-5}$ to $1\times10^{-2}$ mole.

In the layers constituting the heat developable photographic material, various surfactants can be used for the purposes of assisting coating, improving separation, improving slipperiness, preventing electric charge, and accelerating development. Examples of the surfactant are described in Research Disclosures stated above, JP-A-62-173463, JP-A-62-183457, etc.

The layers constituting the heat developable photographic material may contain an organic fluoro compound for the purposes of improving slipperiness, preventing electric charge and improving separation. Typical examples of the organic fluoro compound include fluorine surfactants described in JP-B-57-9053, columns 8 to 17, JP-A-51-20944, JP-A-62-135825, etc. and hydrophobic fluorine compounds such as oily fluorine compounds (for example, fluorine oil) and solid fluorine compounds (for example, ethylene tetrafluoride resins).

The heat developable photographic materials can contain a matte agent for the purposes of preventing adhesion, improving slipperiness and delustering surfaces of the photographic material. Examples of the matte agent include compounds such as benzoguanamine resin beads, polycarbonate resin beads and AS resin beads described in JP-A-63-274944 and JP-A-63-274952, as well as compounds such as silicon dioxide, polyolefins and polymethacrylates described in JP-A-61-88256, page 29. In addition, compounds described in Research Disclosures stated above can be used. The matte agent can be added not only to the uppermost layer (protective layer), but also to the lower layers as needed.

Besides, the layers constituting the heat developable photographic material may contain a thermal solvent, an antifoaming agent, a microbicidal antifungal agent and colloidal silica. Examples of these additives are described in JP-A-61-88256, pages 26 to 32, JP-A-3-11338 and JP-B-2-51496.

In the present invention, a solvent may be used to accelerate the development reaction at the time of heat development.

Further, as described in JP-A-59-218443 and JP-A-61-238056, methods are also useful in which the heat developable photographic materials are heated in the presence of a small amount of a solvent (particularly, water) to conduct development and transfer concurrently or continuously. In this system, the heating temperature is preferably between 50° C. and the boiling point of the solvent. For example, when the solvent is water, the temperature is preferably from 50° C. to 100° C.

Examples of the solvent used for the acceleration of development include water and a basic aqueous solution containing an inorganic alkali metal salt or an organic base (as these bases, bases described for the image formation accelerator are used). Further, a low boiling solvent or a mixed solution of a low boiling solvent and water or a basic aqueous solution can also be used. In addition, the solvent may contain a surfactant, an antifoggant, a slightly soluble metal salt, a complex forming compound, etc.

Such a solvent can be used by the methods of imparting them to a base generating material, a light-sensitive material or both. The solvent can be used in such a small amount as not more than the weight of the solvent corresponding to the maximum swelling volume of the total coated film (particularly, not more than the amount obtained by subtracting the weight of the total coated film from the weight of the solvent corresponding to the maximum swelling volume of the total coated film).

Methods for imparting the solvent to the light-sensitive layer or base generating layer include, for example, methods described in JP-A-61-147244, page 26. The solvent can also be previously contained in the light-sensitive material, the base generating material or both in the form of microcapsules in which the solvent is confined.

Further, in order to accelerate development, a system can be employed in which the light-sensitive material or the base generating material is allowed to contain a hydrophilic solvent which is solid at room temperature, but is fusible at high temperatures. The hydrophilic thermal solvent may be contained in either the light-sensitive material or the base generating material, or in both. A layer in which the solvent is contained may be any of an emulsion layer, an intermediate layer, a protective layer and a base generating layer. However, it is preferred that the solvent is contained in the base generating layer and/or a layer adjacent thereto.

Examples of the hydrophilic thermal solvent include urea and derivatives thereof, pyridine and derivatives thereof, amides, sulfonamides, imides, alcohols, oximes and other heterocycles. Further, in order to accelerate dye transfer, a high boiling organic solvent may be contained in the light-sensitive material and/or the base generating material.

In the present invention, besides the above-mentioned solvent, an image formation accelerator can be used in the light-sensitive material and/or the base generating material. The image formation accelerator has the functions of accelerating the oxidation-reduction reaction with silver salt oxidizing agents and forming dyes from dye donating substances. They can be classified into bases or base precursors, nucleophilic compounds, high boiling organic solvents (oils), thermal solvents, surfactants, compounds having the mutual interaction with silver or silver ions, etc., according to physicochemical functions. However, these substances generally have combined functions, and usually have some of the above-mentioned accelerating effects in combination. Details thereof are described in U.S. Pat. No. 4,678,739, columns 38 to 40.

The base precursors include salts of an organic acid and a base which are decarboxylated by heat, and compounds releasing an amine by the intramolecular nucleophilic displacement reaction, the Lossen rearrangement or the Beckmann rearrangement. Examples thereof are described in U.S. Pat. Nos. 4,511,493 and JP-A-62-65038.

In the system in which the heat development is performed in the presence of a small amount of water, the bases and/or the base precursors are preferably contained in the base generating materials in terms of enhancing preservability of the photographic material.

Besides the above, combinations of a slightly soluble metal compound and a compound (also referred to as a complex forming compound) which can react with the metal ion contained in the slightly soluble metal compound to form a complex as described in EP-A-210,660 and U.S. Pat. No. 4,740,445, and compounds generating a base by electrolysis as described in JP-A-61-232451, can also be used as the base precursor. In particular, the former is effective. It is advantageous that the slightly soluble metal compound and the complex forming compound are separately added to the light-sensitive material and the base generating material.

In the present invention, various development stoppers can be used in the light-sensitive material and/or the base generating material for the purpose of obtaining always constant images against fluctuations in processing temperature and processing time at the time of development.

The development stopper as used herein is a compound which, after normal development, rapidly neutralizes or reacts with a base to reduce the concentration of the base contained in a film, thereby stopping development, or a compound which interacts with silver and a silver salt to inhibit development. Examples thereof include acid precursors releasing an acid by heating, electrophilic compounds which conduct replacement reaction with coexisting bases by heating, nitrogen-containing heterocyclic compounds, mercapto compounds and precursors thereof. More specifically, they are described in JP-A-62-253159, pages 31 and 32.

Methods for exposing the heat developable photographic materials to record an image include, for example, methods of directly taking landscape photographs or human subject photographs by use of cameras, methods of exposing the photographic materials through reversal films or negative films by use of printers or enlargers, methods of subjecting original pictures to scanning exposure through slits by use of exposing devices of copying machines, methods of allowing light emitting diodes or various lasers (such as laser diodes and gas lasers) to emit light by image information through electric signals to subject the photographic materials to scanning exposure (methods described in JP-A-2-129625, JP-A-5-176144, JP-A-5-199372 and JP-A-6-1-27021), and methods of supplying image information to image displays such as CRTs, liquid crystal displays, electroluminescence displays and plasma displays to expose the photographic material directly or through an optical system.

As described above, light sources and exposing methods such as natural light, tungsten lamps, light emitting diodes, laser sources and CRT light sources described in U.S. Pat. No. 4,500,626, column 56, JP-A-2-53378 and JP-A-2-54672 can be used to record an image on the heat developable photographic materials.

Further, images can also be exposed using wavelength converting elements in which non-linear optical materials and coherent light sources such as laser beams are combined. Here, the non-linear optical material is a material which can express non-linearity between an electrical field and polarization appearing when a strong optical electrical field such as a laser beam is given. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As the forms of the wavelength converting elements, the single crystal optical waveguide path type and the fiber type are known, and both are useful.

Further, in the above-mentioned image information, image signals obtained from video cameras, electronic still cameras, etc., television signals represented by the Nippon Television Signal Criteria (NTSC), image signals obtained by dividing original pictures into many picture elements with scanners, etc. and image signals produced by use of computers represented by CGs and CADs can be utilized.

The heat developable photographic material of the present invention may have a conductive exothermic layer as a heating means for heat development. In this case, an exothermic element described in JP-A-61-145544 can be utilized.

The heating temperature in the heat development stage is generally from about 80° C. to about 180° C., and the heating time is generally from 0.1 seconds to 60 seconds.

Heating methods in the development stage include a method of bringing the photographic material into contact with a heated block, a heated plate, a hot presser, a heated roll, a heated drum, a halogen lamp heater, an infrared or far infrared lamp heater, etc., and a method of passing the photographic material through an atmosphere of high temperature.

To superposition of the heat developable photographic materials and the dye fixing materials, methods described in JP-A-62-253159 and JP-A-61-147244, page 27 can be applied.

The effects of the present invention will be illustrated below by reference to the Examples and Comparative Examples.

EXAMPLE 1

Methods for Preparing Light-Sensitive Silver Halide Emulsions Light-Sensitive Silver Halide Emulsion (1) (for Red-Sensitive Emulsion Layer)

Solution (1) and solution (2) shown in Table 1 were concurrently added to a well-stirred aqueous solution of gelatin (a solution of 16 g of gelatin, 0.24 g of potassium bromide, 1.6 g of sodium chloride and 24 mg of compound (a) in 540 ml of water heated at 55° C.) at the same flow rate for 19 minutes. After 5 minutes, solutions (3) and (4) shown in Table 1 were concurrently added thereto at the same flow rate for 24 minutes. After washing and salt removal by a conventional method, 17.6 g of lime-treated ossein gelatin and 56 mg of compound (b) were added to adjust the pH and the pAg to 6.2 and 7.7, respectively. Then, 0.41 g of a decomposed product of ribonucleic acid and 1.02 mg of trimethylthiourea were added, followed by optimum chemical sensitization at 60° C. Thereafter, 0.18 g of 4-hydroxy-6-methyl-1,3,3a, 7-tetraazainedene, 64 mg of sensitizing dye (c) and 0.41 g of potassium bromide were in turn added, followed by cooling. Thus, 590 g of a monodisperse cubic silver chlorobromide emulsion having a mean grain size of 0.30 μm was obtained.

TABLE 1

| | Solution (1) | Solution (2) | Solution (3) | Solution (4) |
|---|---|---|---|---|
| $AgNO_3$ | 24.0 g | — | 56.0 g | — |
| $NH_4NO_3$ | 50.0 mg | — | 50.0 mg | — |
| KBr | — | 10.9 g | — | 35.3 g |

TABLE 1-continued

| | Solution (1) | Solution (2) | Solution (3) | Solution (4) |
|---|---|---|---|---|
| NaCl | — | 2.88 g | — | 1.92 g |
| $K_2IrCl_6$ | — | 0.07 mg | — | — |
| Amount Completed | Water to make 130 ml | Water to make 200 ml | Water to make 130 ml | Water to make 200 ml |

Compound (a)

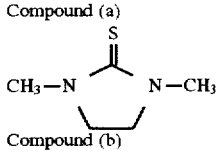

Compound (b)

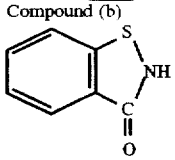

Dye (c)

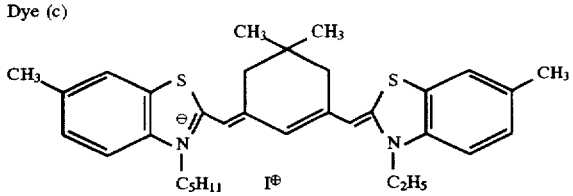

Light-Sensitive Silver Halide Emulsion (2) (for Green-Sensitive Emulsion Layer)

Solution (1) and solution (2) shown in Table 2 were concurrently added to a well-stirred aqueous solution of gelatin (a solution of 20 g of gelatin, 0.30 g of potassium bromide, 2.0 g of sodium chloride and 30 mg of compound (a) in 600 ml of water heated at 46° C.) at the same flow rate for 10 minutes. After 5 minutes, solution (3) and solution (4) shown in Table 2 were further concurrently added thereto at the same flow rate for 30 minutes. One minute after termination of addition of solutions (3) and (4), 600 ml of a solution of sensitizing dyes in methanol (containing 360 mg of sensitizing dye ($d_1$) and 73.4 mg of sensitizing dye ($d_2$)) was added in one lot. After washing and salt removal (conducted using precipitating agent (e) at pH 4.0) by a conventional method, 22 g of lime-treated ossein gelatin was added to adjust the pH and the pAg to 6.0 and 7.6, respectively. Then, 1.8 mg of sodium thiosulfate and 180 mg of 4-hydroxy-6-methy-1,3,3a, 7-tetraazainedene were added, followed by optimum chemical sensitization at 60° C. Thereafter, 90 mg of antifoggant (f), and 70 mg of compound (b) and 3 ml of compound (g) as preservatives were added, followed by cooling. Thus, 635 g of a monodisperse cubic silver chlorobromide emulsion having a mean grain size of 0.30 μm was obtained.

TABLE 2

| | Solution (1) | Solution (2) | Solution (3) | Solution (4) |
|---|---|---|---|---|
| $AgNO_3$ | 10.0 g | – | 90.0 g | – |
| $NH_4NO_3$ | 60.0 mg | – | 380 mg | – |
| KBr | – | 3.50 g | – | 57.1 g |
| NaCl | – | 1.72 g | – | 3.13 g |
| $K_2IrCl_6$ | – | – | – | 0.03 mg |
| Amount Completed | Water to make 126 ml | Water to make 131 ml | Water to make 280 ml | Water to make 289 ml |

Dye ($d_1$)

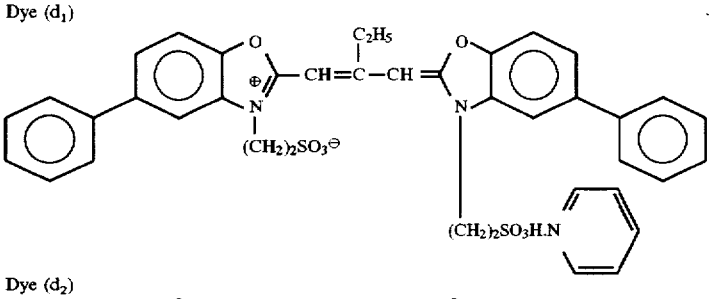

Dye ($d_2$)

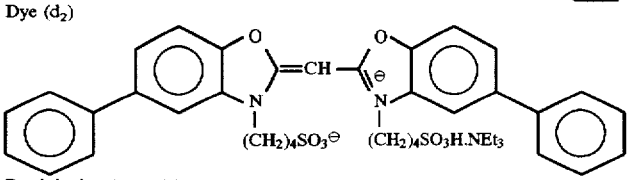

Precipitating Agent (e)

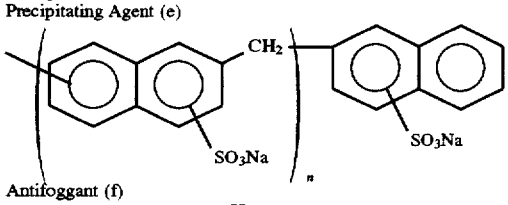

Antifoggant (f)

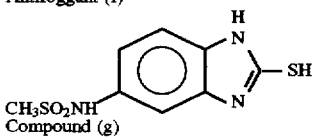

Compound (g)

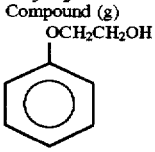

Light-Sensitive Silver Halide Emulsion (3) (for Blue-Sensitive Emulsion Layer)

First, addition of solution (2) shown in Table 3 to a well-stirred aqueous solution of gelatin (a solution of 31.6 g of gelatin, 2.5 g of potassium bromide and 13 mg of compound (a) in 584 ml of water heated at 70° C.) was started. After 10 minutes, addition of solution (1) was started. Solutions (1) and (2) were thereafter added over a period of 30 minutes. Five minutes after termination of addition of solution (2), addition of solution (4) shown in Table 3 was further started, and after 10 seconds, addition of solution (3) was started. Solution (3) was added over a period of 27 minutes and 50 seconds, and solution (4) was added over a period of 28 minutes. After washing and salt removal (conducted using precipitating agent (j) at pH 3.9) by a conventional method, 24.6 g of lime-treated ossein gelatin and 56 mg of compound (b) were added to adjust the pH and the pAg to 6.1 and 8.5, respectively. Then, 0.55 mg of sodium thiosulfate was added, followed by optimum chemical sensitization at 65° C. Thereafter, 0.35 g of sensitizing dye (h), 56 mg of antifoggant (i) and 2.3 ml of compound (g) as a preservative were added, followed by cooling. Thus, 582 g of a monodisperse octahedral silver bromide emulsion having a mean grain size of 0.55 μm was obtained.

TABLE 3

| | Solution (1) | Solution (2) | Solution (3) | Solution (4) |
|---|---|---|---|---|
| $AgNO_3$ | 15.8 g | – | 72.2 g | – |
| $NH_4NO_3$ | 68.0 mg | – | 308 mg | – |
| KBr | – | 11.4 g | – | 52.2 g |

TABLE 3-continued

| | Solution (1) | Solution (2) | Solution (3) | Solution (4) |
|---|---|---|---|---|
| Amount Completed | Water to make 134 ml | Water to make 134 ml | Water to make 194 ml | Water to make 195 ml |

Precipitating Agent (j)

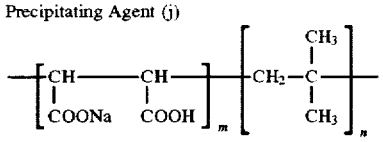

m + n = 1

Dye (h)

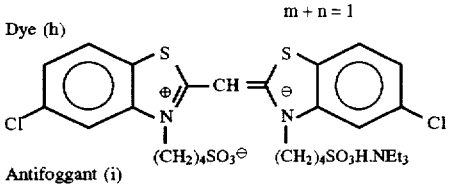

Antifoggant (i)

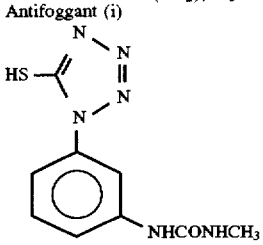

Preparation of Zinc Hydroxide Dispersion

A powder of zinc hydroxide (31 g) in which the grain size of primary grains is 0.2 μm, 1.6 g of carboxymethyl cellulose and 0.4 g of polysodium acrylate as dispersing agents, 8.5 g of lime-treated ossein gelatin and 158.5 ml of water were mixed, and the resulting mixture was dispersed in a mill using glass beads for 1 hour. After dispersion, the glass beads were filtered off to obtain 188 g of a zinc hydroxide dispersion.

Preparation of Emulsified Dispersions of Couplers

The oil phase ingredients and aqueous phase ingredients shown in Table 4 each were dissolved to form homogeneous solutions having a temperature of 60° C. Both the solutions were combined and dispersed in a 1-liter stainless steel vessel with a dissolver equipped with a 5-cm diameter disperser at 10,000 rpm for 20 minutes. Then, hot water was added in amounts shown in Table 4 as post water addition, followed by mixing at 2,000 rpm for 10 minutes. Thus, emulsified dispersions of three colors of cyan, magenta and yellow were prepared.

TABLE 4

| | | Cyan | Magenta | Yellow |
|---|---|---|---|---|
| Oil Phase | Cyan Coupler (1) | 4.95 g | — | — |
| | Magenta Coupler (2) | — | 6.36 g | — |
| | Yellow Coupler (3) | — | — | 5.92 g |
| | Developing Agent (4) | 2.51 g | 2.34 g | 2.34 g |
| | Antifoggant (5) | 0.08 g | 0.08 g | 0.08 g |
| | High Boiling Solvent (6) | 2.98 g | 3.18 g | 2.96 g |
| | Ethyl Acetate | 24 ml | 24 ml | 24 ml |
| Aqueous | Lime-Treated Gelatin | 5.0 g | 5.0 g | 5.0 g |
| | Surfactant (7) | 0.40 g | 0.40 g | 0.40 g |

TABLE 4-continued

| | | Cyan | Magenta | Yellow |
|---|---|---|---|---|
| Phase | Water | 75.0 ml | 75.0 ml | 75.0 ml |
| | Post Water Addition | 60.0 ml | 60.0 ml | 60.0 ml |

Cyan Coupler (1) (C-48)

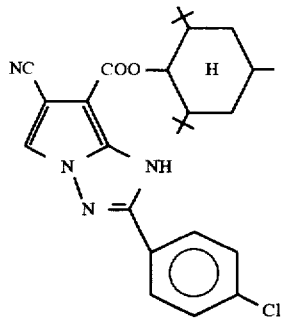

Magenta Coupler (2) (C-22)

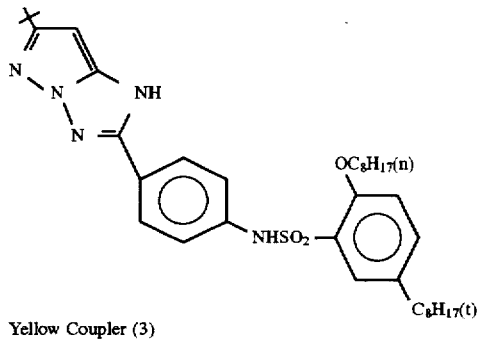

Yellow Coupler (3) (C-7)

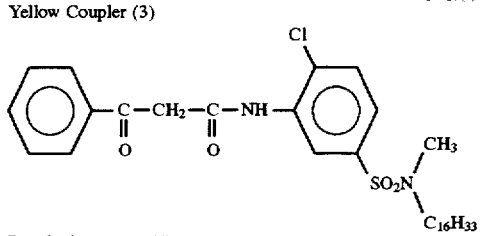

Developing Agent (4) (D-1)

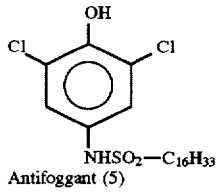

Antifoggant (5)

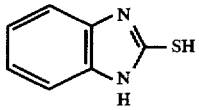

Hardener (13)

$CH_2=CH-SO_2-CH_2-SO_2-CH=CH_2$

High Boiling Solvent (6)

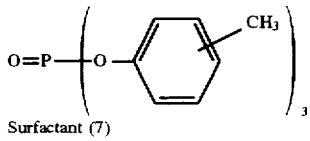

Surfactant (7)

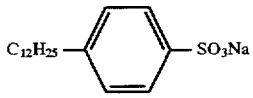

Using the materials thus obtained, heat developable color photographic material 101 for comparison having the multilayer constitution shown in Table 5 was prepared.

TABLE 5

Constitution of Photographic Material 101

| Layer Constitution | Material Added | Amount Added (mg/m²) |
|---|---|---|
| 6th Layer Protective Layer (PC) | Lime-Treated Gelatin | 1940 |
| | Matte Agent (Silica) | 200 |
| | Surfactant (8) | 50 |
| | Surfactant (9) | 300 |
| | Zinc Hydroxide | 900 |
| | Water-Soluble Polymer (10) | 120 |
| 5th Layer Yellow Color Formation Layer (BL) | Lime-Treated Gelatin | 4000 |
| | Blue-Sensitive Silver Halide Emulsion | 1728 (converted to silver) |
| | Yellow Coupler (3) | 2368 |
| | Developing Agent (4) | 934 |
| | Antifoggant (5) | 32 |
| | High Boiling Solvent (6) | 1184 |
| | Surfactant (7) | 80 |
| | Water-Soluble Polymer (10) | 40 |
| 4th Layer Intermediate Layer (GMC) | Lime-Treated Gelatin | 970 |
| | Surfactant (8) | 50 |
| | Surfactant (9) | 300 |
| | Hardener (13) | 85 |
| | Water-Soluble Polymer (10) | 60 |
| 3rd Layer Magenta Color Formation Layer (GL) | Lime-Treated Gelatin | 2000 |
| | Green-Sensitive Silver Halide Emulsion | 864 (converted to silver) |
| | Magenta Coupler (2) | 1272 |
| | Developing Agent (4) | 467 |
| | Antifoggant (5) | 16 |
| | High Boiling Solvent (6) | 636 |
| | Surfactant (7) | 40 |
| | Water-Soluble Polymer (10) | 20 |
| 2nd Layer Intermediate Layer (RMC) | Lime-Treated Gelatin | 970 |
| | Surfactant (8) | 50 |
| | Surfactant (9) | 300 |
| | Zinc Hydroxide | 900 |
| | Water-Soluble Polymer (10) | 60 |
| 1st Layer Cyan Color Formation Layer (RL) | Lime-Treated Gelatin | 2000 |
| | Red-Sensitive Silver Halide Emulsion | 864 (converted to silver) |
| | Cyan Coupler (1) | 990 |
| | Developing Agent (4) | 502 |
| | Antifoggant (5) | 16 |
| | High Boiling Solvent (6) | 495 |
| | Surfactant (7) | 40 |
| | Water-Soluble Polymer (10) | 20 |

Transparent PET Base (102 μm)
Surfactant (8)

TABLE 5-continued

Constitution of Photographic Material 101

| Layer Constitution | Material Added | Amount Added (mg/m²) |
|---|---|---|

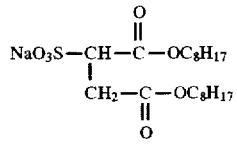

Surfactant (9)

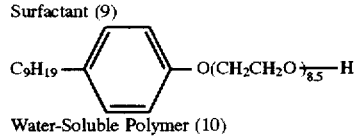

Water-Soluble Polymer (10)

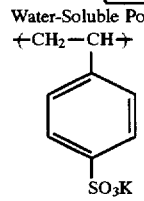

Then, photographic materials 102 to 120 were prepared in the same manner as the preparation of photographic material 101 except that the developing agent and the couplers were replaced and reducing agents were added to the intermediate layers as shown in Table 6. A magazine of FUJIX PICTROSTAT 200 (manufactured by Fuji Photo Film Co. Ltd.) was loaded with each of photographic materials 101 to 120 thus obtained, and a slide enlarging unit is equipped with B, G and R filters continuously changed in density to conduct heat development under the standard conditions.

When the image-received materials were separated after processing, color images of cyan, magenta and yellow were clearly obtained on the photographic material side, corresponding to the filters through which the samples were exposed. Immediately after processing, the maximum density (Dmax) and the minimum density (Dmin) of each color formation layer of each sample were measured for each of trucks B, G and R with an X-rite densitometer. Results are shown in Table 7.

TABLE 6

| | R L | | G L | | B L | | RMC/GMC | |
|---|---|---|---|---|---|---|---|---|
| Sample Name | Coupler | Developing Agent | Coupler | Developing Agent | Coupler | Developing Agent | Reducing Agent | Added*) |
| 101 (Comparison) | C-48 | D-1 | C-22 | D-1 | C-7 | D-1 | | |
| 102 (Comparison) | C-48 | D-17 | C-22 | D-17 | C-7 | D-17 | | |
| 103 (Comparison) | C-45 | D-24 | C-27 | D-24 | C-7 | D-24 | | |
| 104 (Comparison) | C-66 | D-26 | C-48 | D-26 | C-22 | D-26 | | |

TABLE 6-continued

| Sample Name | R L Coupler | R L Developing Agent | G L Coupler | G L Developing Agent | B L Coupler | B L Developing Agent | RMC/GMC Reducing Agent | RMC/GMC Added*) |
|---|---|---|---|---|---|---|---|---|
| 105 (Comparison) | C-119 | D-39 | C-104 | D-39 | C-77 | D-39 | | |
| 106 (Comparison) | C-119 | D-41 | C-104 | D-41 | C-77 | D-41 | | |
| 107 (Comparison) | C-119 | D-45 | C-104 | D-45 | C-77 | D-45 | | |
| 108 (Comparison) | C-142 | D-46 | C-132 | D-46 | C-100 | D-46 | | |
| 109 (Comparison) | C-48 | D-1 | C-22 | D-1 | C-7 | D-1 | A | 2 |
| 110 (Comparison) | C-119 | D-34 | C-104 | D-34 | C-77 | D-34 | A | 2 |
| 111 (Comparison) | C-48 | D-17 | C-22 | D-17 | C-7 | D-17 | B | 2 |
| 112 (Comparison) | C-119 | D-41 | C-104 | D-41 | C-77 | D-41 | B | 2 |
| 113 (Invention) | C-48 | D-1 | C-104 | D-34 | C-7 | D-1 | | |
| 114 (Invention) | C-119 | D-34 | C-22 | D-1 | C-77 | D-34 | | |
| 115 (Invention) | C-119 | D-41 | C-22 | D-1 | C-77 | D-41 | | |
| 116 (Invention) | C-119 | D-34 | C-22 | D-17 | C-100 | D-46 | | |
| 117 (Invention) | C-119 | D-41 | C-27 | D-24 | C-100 | D-46 | | |
| 118 (Invention) | C-119 | D-41 | C-22 | D-1 | C-100 | D-46 | | |
| 119 (Invention) | C-48 | D-1 | C-104 | D-34 | C-7 | D-24 | | |
| 120 (Invention) | C-48 | D-17 | C-104 | D-41 | C-22 | D-16 | | |

*)Added: mmol/$m^2$

Reducing Agent A

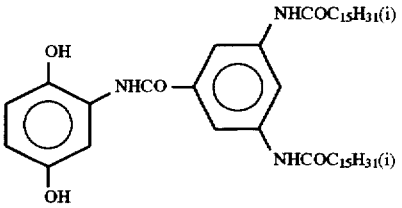

Reducing Agent B

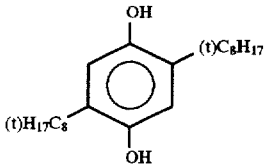

TABLE 7

Results of Sensitometry

| | Track R, Dmax Area | | | Track G, Dmax Area | | | Track B, Dmax Area | | | Dmin | | |
|---|---|---|---|---|---|---|---|---|---|---|---|---|
| | Cyan | Magenta | Yellow | Cyan | Magenta | Yellow | Cyan | Magenta | Yellow | Cyan | Magenta | Yellow |
| 101 | 2.10 | 1.03 | 0.87 | 1.22 | 2.22 | 1.15 | 0.72 | 1.12 | 2.03 | 0.24 | 0.29 | 0.22 |
| 102 | 2.11 | 1.08 | 0.88 | 1.23 | 2.23 | 1.16 | 0.73 | 1.13 | 2.00 | 0.25 | 0.28 | 0.21 |
| 103 | 2.10 | 1.06 | 0.86 | 1.19 | 2.23 | 1.14 | 0.77 | 1.14 | 2.01 | 0.24 | 0.28 | 0.22 |
| 104 | 2.11 | 1.12 | 0.89 | 1.25 | 2.23 | 1.17 | 0.72 | 1.15 | 2.01 | 0.24 | 0.29 | 0.22 |
| 105 | 2.09 | 1.10 | 0.87 | 1.26 | 2.20 | 1.16 | 0.73 | 1.13 | 2.00 | 0.24 | 0.28 | 0.21 |
| 106 | 2.11 | 1.08 | 0.89 | 1.24 | 2.24 | 1.15 | 0.74 | 1.14 | 2.01 | 0.24 | 0.28 | 0.22 |
| 107 | 2.10 | 1.09 | 0.90 | 1.23 | 2.24 | 1.18 | 0.72 | 1.12 | 2.01 | 0.24 | 0.29 | 0.21 |
| 108 | 2.12 | 1.08 | 0.87 | 1.22 | 2.23 | 1.16 | 0.71 | 1.15 | 2.03 | 0.25 | 0.29 | 0.21 |
| 109 | 1.52 | 0.32 | 0.33 | 0.25 | 1.55 | 0.32 | 0.25 | 0.29 | 1.11 | 0.24 | 0.28 | 0.21 |

TABLE 7-continued

Results of Sensitometry

| | Track R, Dmax Area | | | Track G, Dmax Area | | | Track B, Dmax Area | | | Dmin | | |
|---|---|---|---|---|---|---|---|---|---|---|---|---|
| | Cyan | Magenta | Yellow | Cyan | Magenta | Yellow | Cyan | Magenta | Yellow | Cyan | Magenta | Yellow |
| 110 | 1.51 | 0.33 | 0.32 | 0.26 | 1.53 | 0.33 | 0.25 | 0.30 | 1.10 | 0.25 | 0.28 | 0.22 |
| 111 | 1.53 | 0.22 | 0.33 | 0.26 | 1.57 | 0.35 | 0.24 | 0.29 | 1.10 | 0.25 | 0.29 | 0.22 |
| 112 | 1.55 | 0.31 | 0.31 | 0.24 | 1.56 | 0.34 | 0.25 | 0.28 | 1.11 | 0.24 | 0.28 | 0.21 |
| 113 | 2.10 | 0.33 | 0.33 | 0.25 | 2.23 | 0.34 | 0.24 | 0.29 | 2.01 | 0.25 | 0.29 | 0.22 |
| 114 | 2.12 | 0.33 | 0.34 | 0.26 | 2.24 | 0.33 | 0.24 | 0.29 | 2.00 | 0.24 | 0.28 | 0.22 |
| 115 | 2.13 | 0.34 | 0.32 | 0.25 | 2.26 | 0.32 | 0.24 | 0.29 | 2.03 | 0.25 | 0.29 | 0.21 |
| 116 | 2.12 | 0.32 | 0.33 | 0.25 | 2.21 | 0.34 | 0.25 | 0.29 | 2.02 | 0.24 | 0.28 | 0.21 |
| 117 | 2.10 | 0.34 | 0.32 | 0.24 | 2.23 | 0.34 | 0.24 | 0.29 | 2.01 | 0.24 | 0.29 | 0.21 |
| 118 | 2.11 | 0.34 | 0.33 | 0.26 | 2.22 | 0.32 | 0.24 | 0.28 | 2.01 | 0.25 | 0.28 | 0.22 |
| 119 | 2.10 | 0.33 | 0.32 | 0.25 | 2.24 | 0.33 | 0.25 | 0.29 | 2.01 | 0.25 | 0.29 | 0.22 |
| 120 | 2.13 | 0.32 | 0.33 | 0.24 | 2.23 | 0.33 | 0.24 | 0.28 | 2.02 | 0.24 | 0.28 | 0.21 |

From the results shown in Table 7, some color mixture was observed on the color formation region of each monochrome for samples 101 to 104 in which the 4-equivalent couplers and the developing agents corresponding thereto were used in all of the BL, GL and RL layers, and for samples 105 to 109 in which the 2-equivalent couplers and the developing agents corresponding thereto were similarly used. For samples 109 to 112 in which the reducing agents were added to the intermediate layers to improve this disadvantages color mixture was improved, but a decrease in Dmax was observed. In contrast, the results showed that photographic materials 113 to 120 of the present invention were excellent in discrimination and provided images improved in color mixture.

EXAMPLE 2

Benzotriazole Silver Emulsion (Organic Silver Salt)

In 300 ml of water, 28 g of gelatin and 13.2 g of benzotriazole were dissolved. The resulting solution was maintained at 40° C. and stirred. A solution of 17 g of silver nitrate in 100 ml of water was added to this solution over a period of 2 minutes. The pH of the resulting benzotriazole silver emulsion was adjusted to remove excess salts by sedimentation. Then, the pH was adjusted to 6.30 to obtain 400 g of a benzotriazole silver emulsion.

Using the benzotriazole silver emulsion thus obtained, heat developable color photographic material 201 shown in Table 8 was prepared.

TABLE 8

Constitution of Photographic Material 201

| Layer Constitution | Material Added | Amount Added (mg/m$^2$) |
|---|---|---|
| 6th Layer Protective Layer (PC) | Lime-Treated Gelatin | 1940 |
| | Matte Agent (Silica) | 200 |
| | Surfactant (8) | 50 |
| | Surfactant (9) | 300 |
| | Base Precursor (11) | 1400 |
| | Water-Soluble Polymer (10) | 120 |
| 5th Layer Yellow Color Formation Layer (BL) | Lime-Treated Gelatin | 4000 |
| | Blue-Sensitive Silver Halide Emulsion | 1728 (converted to silver) |

TABLE 8-continued

Constitution of Photographic Material 201

| Layer Constitution | Material Added | Amount Added (mg/m$^2$) |
|---|---|---|
| | Benzotriazole Silver Emulsion | 500 (converted to silver) |
| | Yellow Coupler (3) | 2368 |
| | Developing Agent (4) | 934 |
| | Antifoggant (5) | 32 |
| | High Boiling Solvent (6) | 1184 |
| | Surfactant (7) | 80 |
| | Thermal Solvent (12) | 1400 |
| | Surfactant (9) | 70 |
| | Water-Soluble Polymer (10) | 40 |
| 4th Layer Intermediate Layer (GMC) | Lime-Treated Gelatin | 970 |
| | Surfactant (8) | 50 |
| | Surfactant (9) | 300 |
| | Base Precursor (11) | 1400 |
| | Water-Soluble Polymer (10) | 60 |
| 3rd Layer Magenta Color Formation Layer (GL) | Lime-Treated Gelatin | 2000 |
| | Green-Sensitive Silver Halide Emulsion | 864 (converted to silver) |
| | Benzotriazole Silver Emulsion | 200 (converted to silver) |
| | Magenta Coupler (2) | 1272 |
| | Developing Agent (4) | 467 |
| | Antifoggant (5) | 16 |
| | High Boiling Solvent (6) | 636 |
| | Surfactant (7) | 40 |
| | Thermal Solvent (12) | 700 |
| | Surfactant (9) | 35 |
| | Water-Soluble Polymer (10) | 20 |
| 2nd Layer Intermediate Layer (RMC) | Lime-Treated Gelatin | 970 |
| | Surfactant (8) | 50 |
| | Surfactant (9) | 300 |
| | Base Precursor (11) | 1400 |
| | Water-Soluble Polymer (10) | 60 |
| 1st Layer Cyan Color Formation Layer (RL) | Lime-Treated Gelatin | 2000 |
| | Red-Sensitive Silver Halide Emulsion | 864 (converted to silver) |
| | Benzotriazole Silver Emulsion | 200 (converted to silver) |
| | Cyan Coupler (1) | 990 |
| | Developing Agent (4) | 502 |
| | Antifoggant (5) | 16 |
| | High Boiling Solvent (6) | 495 |
| | Surfactant (7) | 40 |
| | Thermal Solvent (12) | 700 |

TABLE 8-continued

| Constitution of Photographic Material 201 | | |
|---|---|---|
| Layer Constitution | Material Added | Amount Added ($mg/m^2$) |
| | Surfactant (9) | 35 |
| | Water-Soluble Polymer (10) | 20 |

Transparent PET Base (102 μm)

Base Precursor (11)

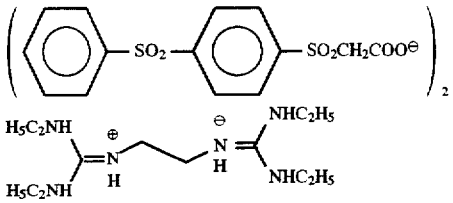

Thermal Solvent (12)

D-Sorbitol

Then, photographic materials 202 to 215 were prepared in the same manner as the preparation of photographic material 201 except that the developing agent and the couplers were replaced and reducing agents were added to the intermediate layers as shown in Table 9. Each sample was exposed at 2000 lux for 1 second through B, G and R wedges continuously changed in density. The exposed sample was brought into contact with a heat drum heated at 130° C. on its back side to heat it for 10 seconds. Upon separation from the drum after processing, color images of cyan, magenta and yellow were clearly obtained on the photographic material corresponding to the B, G and R filters. Immediately after processing, the maximum density (Dmax) and the minimum density (Dmin) of this sample were measured with an X-rite densitometer. Results are shown in Table 10.

TABLE 9

| | RL | | GL | | BL | | RMC/GMC | |
|---|---|---|---|---|---|---|---|---|
| Sample Name | Coupler | Developing Agent | Coupler | Developing Agent | Coupler | Developing Agent | Reducing Agent | Added*) |
| 201 (Comparison) | C-48 | D-1 | C-22 | D-1 | C-7 | D-1 | | |
| 202 (Comparison) | C-48 | D-17 | C-22 | D-17 | C-7 | D-17 | | |
| 203 (Comparison) | C-45 | D-24 | C-27 | D-24 | C-7 | D-24 | | |
| 204 (Comparison) | C-142 | D-46 | C-132 | D-46 | C-100 | D-46 | | |
| 205 (Comparison) | C-119 | D-34 | C-104 | D-34 | C-77 | D-34 | | |
| 206 (Comparison) | C-119 | D-41 | C-104 | D-41 | C-77 | D-41 | | |
| 207 (Comparison) | C-119 | D-45 | C-104 | D-45 | C-77 | D-45 | | |
| 208 (Comparison) | C-48 | D-1 | C-22 | D-1 | C-7 | D-1 | A | 2 |
| 209 (Comparison) | C-48 | D-1 | C-22 | D-1 | C-7 | D-1 | A | 3 |
| 210 (Comparison) | C-119 | D-34 | C-104 | D-34 | C-77 | D-34 | B | 2 |
| 211 (Invention) | C-48 | D-1 | C-104 | D-34 | C-7 | D-1 | | |
| 212 (Invention) | C-119 | D-34 | C-22 | D-1 | C-77 | D-34 | | |
| 213 (Invention) | C-119 | D-41 | C-22 | D-1 | C-77 | D-41 | | |
| 214 (Invention) | C-119 | D-41 | C-22 | D-17 | C-100 | D-46 | | |
| 215 (Invention) | C-119 | D-34 | C-27 | D-24 | C-100 | D-46 | | |

*)Added: $mmol/m^2$

TABLE 10

Results of Sensitometry

| | Track R, Dmax Area | | | Track G, Dmax Area | | | Track B, Dmax Area | | | Dmin | | |
|---|---|---|---|---|---|---|---|---|---|---|---|---|
| | Cyan | Magenta | Yellow | Cyan | Magenta | Yellow | Cyan | Magenta | Yellow | Cyan | Magenta | Yellow |
| 201 | 2.08 | 1.03 | 0.89 | 1.19 | 2.22 | 1.17 | 0.72 | 1.03 | 2.02 | 0.24 | 0.30 | 0.24 |
| 202 | 2.09 | 1.08 | 0.88 | 1.18 | 2.21 | 1.16 | 0.73 | 1.05 | 2.01 | 0.25 | 0.31 | 0.25 |
| 203 | 2.10 | 1.06 | 0.79 | 1.20 | 2.20 | 1.12 | 0.77 | 1.04 | 2.03 | 0.24 | 0.32 | 0.25 |
| 204 | 2.10 | 1.12 | 0.82 | 1.24 | 2.21 | 1.17 | 0.72 | 1.02 | 2.04 | 0.24 | 0.31 | 0.24 |
| 205 | 2.09 | 1.10 | 0.85 | 1.21 | 2.24 | 1.17 | 0.73 | 1.03 | 2.02 | 0.24 | 0.31 | 0.24 |
| 206 | 2.10 | 1.08 | 0.84 | 1.23 | 2.22 | 1.15 | 0.74 | 1.05 | 2.01 | 0.24 | 0.32 | 0.24 |
| 207 | 2.08 | 1.09 | 0.90 | 1.20 | 2.21 | 1.16 | 0.72 | 1.07 | 2.02 | 0.24 | 0.31 | 0.25 |
| 208 | 1.49 | 0.32 | 0.31 | 0.23 | 1.49 | 0.31 | 0.24 | 0.30 | 2.01 | 0.25 | 0.31 | 0.25 |
| 209 | 1.49 | 0.33 | 0.32 | 0.25 | 1.48 | 0.32 | 0.25 | 0.31 | 1.14 | 0.24 | 0.32 | 0.24 |
| 210 | 1.49 | 0.31 | 0.31 | 0.24 | 1.42 | 0.32 | 0.23 | 0.32 | 1.13 | 0.25 | 0.31 | 0.24 |
| 211 | 2.10 | 0.31 | 0.32 | 0.23 | 2.24 | 0.31 | 0.24 | 0.33 | 1.14 | 0.25 | 0.31 | 0.24 |
| 212 | 2.09 | 0.31 | 0.33 | 0.24 | 2.23 | 0.32 | 0.23 | 0.31 | 1.15 | 0.24 | 0.32 | 0.24 |
| 213 | 2.09 | 0.32 | 0.32 | 0.23 | 2.22 | 0.33 | 0.24 | 0.31 | 2.02 | 0.25 | 0.31 | 0.25 |
| 214 | 2.10 | 0.34 | 0.32 | 0.23 | 2.20 | 0.31 | 0.25 | 0.31 | 2.03 | 0.24 | 0.31 | 0.25 |
| 215 | 2.09 | 0.33 | 0.33 | 0.25 | 2.20 | 0.32 | 0.24 | 0.32 | 2.01 | 0.25 | 0.31 | 0.24 |

From the results shown in Table 10, similarly to Example 1, some color mixture was observed to the color formation region of each monochrome for samples 201 to 203 in which the 4-equivalent couplers and the developing agents corresponding thereto were used in all of the BL, GL, and RL layers, and for samples 204 to 207 in which the 2-equivalent couplers and the developing agents corresponding thereto were similarly used. For samples 208 to 210 in which the reducing agents were added to the intermediate layers to improve this disadvantage, color mixture was improved, but a decrease in Dmax was observed. In contrast, the results showed that photographic materials 211 to 215 of the present invention were excellent in discrimination and provided images improved in color mixture were obtained.

According to the present invention, the color photographic materials excellent in discrimination and color reproducibility were obtained.

While the invention has been described in detail and with reference to specific embodiments thereof, it will be apparent to one skilled in the art that various changes and modifications can be made therein without departing from the spirit and scope thereof.

What is claimed is:

1. A color photographic material comprising a support having provided thereon at least three light-sensitive silver halide emulsion layers having spectral sensitivities in different wavelength regions, respectively, wherein said light-sensitive silver halide emulsion layers each contain silver halide, a binder, and a coupler, characterized in that at least two light-sensitive emulsion layers contain different coupling developing agents.

2. The color photographic material of claim 1, in which the different developing agents are contained in light-sensitive emulsion layers adjacent to each other and are characterized in that at least one of said developing agents will couple with a coupler of the light-sensitive emulsion layer containing said developing agent itself to form a dye, but will not couple and form a dye with a coupler contained in an adjacent light-sensitive emulsion layer.

3. The color photographic material of claim 2, in which a first light-sensitive emulsion layer contains a 4-equivalent coupler and at least one developing agent selected from the group consisting of compounds represented by formulas (1), (2) and (3) and a second light-sensitive emulsion layer adjacent to the first light-sensitive emulsion layer contains a 2-equivalent coupler and at least one developing agent selected from the group consisting of compounds represented by formulas (4) and (5):

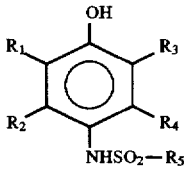

(1)

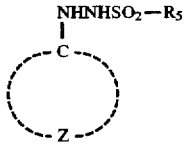

(2)

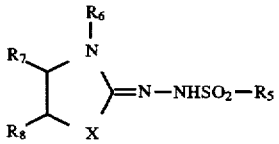

(3)

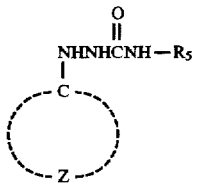

(4)

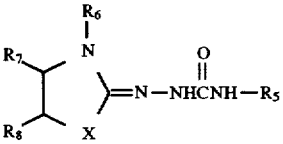

(5)

wherein $R_1$ to $R_4$ each represents a hydrogen atom, a halogen atom, an alkyl group, an aryl group, an alkylcarbonamido group, an arylcarbonamido group, an alkylsulfonamido group, an arylsulfonamido group, an alkoxyl group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl, aryl or heterocyclic group; Z represents an atomic group for forming an aromatic ring (containing a heterocyclic aromatic ring), wherein when Z is a benzene ring, the sum of the Hammett constants ($\sigma_p$) of substituents for the benzene ring is 1 or more; $R_6$ represents a substituted or unsubstituted alkyl group; X represents an oxygen atom, a sulfur atom, a selenium atom or an alkyl-substituted or aryl-substituted tertiary nitrogen atom; and $R_7$ and $R_8$, which may be combined with each other to form a double bond or a ring, each represents a hydrogen atom or a substituent.

4. The color photographic material of claim 3, in which the first light-sensitive emulsion layer contains a developing agent of formula (1) and the second light-sensitive emulsion layer contains a developing agent of formula (4).

5. The color photographic material of claim 4, having a third light-sensitive emulsion layer which contains a 4-equivalent coupler and a developing agent of formula (1), wherein said third light-sensitive emulsion layer is adjacent to said second light-sensitive emulsion layer.

6. The color photographic material of claim 4, having a third light-sensitive emulsion layer which contains a 2-equivalent coupler and a developing agent of formula (4), wherein said third light-sensitive emulsion layer is adjacent to said first light-sensitive emulsion layer.

7. The color photographic material of claim 4, having a third light-sensitive emulsion layer which contains a 2-equivalent coupler and a developing agent of formula (5), wherein said third light-sensitive emulsion layer is adjacent to said first light-sensitive emulsion layer.

8. The color photographic material of claim 3, in which the first light-sensitive emulsion layer contains a developing agent of formula (2) and the second light-sensitive emulsion layer contains a developing agent of formula (4).

9. The color photographic material of claim 8, having a third light-sensitive emulsion layer which contains a 2-equivalent coupler and a developing agent of formula (5), wherein said third light-sensitive emulsion layer is adjacent to said first light-sensitive emulsion layer.

10. The color photographic material of claim 8, having a third light-sensitive emulsion layer which contains a 4-equivalent coupler and a developing agent of formula (1), wherein said third light-sensitive emulsion layer is adjacent to said second light-sensitive emulsion layer.

* * * * *